US006273038B1

(12) United States Patent
Kutlucinar et al.

(10) Patent No.: US 6,273,038 B1
(45) Date of Patent: Aug. 14, 2001

(54) ROTARY DISTRIBUTION SYSTEM INTERNAL COMBUSTION ENGINE

(75) Inventors: Iskender V. Kutlucinar, Kensington; Andrew M. Saul, Chevy Chase, both of MD (US)

(73) Assignee: Hycomp, Inc., Kensington, MD (US)

( * ) Notice: Subject to any disclaimer, the term of this patent is extended or adjusted under 35 U.S.C. 154(b) by 0 days.

(21) Appl. No.: 09/232,929

(22) Filed: Jan. 19, 1999

(51) Int. Cl.[7] ..... F01L 1/28
(52) U.S. Cl. ..... 123/79 R; 123/79 A; 123/184.58
(58) Field of Search ..... 123/79 A, 79 R, 123/184.58, 184.59

(56) References Cited

U.S. PATENT DOCUMENTS

| | | | | |
|---|---|---|---|---|
| 3,071,123 | * | 1/1963 | Gromme | 123/79 A |
| 3,505,983 | * | 4/1970 | Hartel | 123/184.59 |
| 4,262,639 | * | 4/1981 | Motosugi et al. | 123/184.59 |
| 4,441,464 | * | 4/1984 | Toyoda et al. | 123/184.59 |
| 4,450,793 | * | 5/1984 | Sumiyoshi et al. | 123/184.59 |
| 4,674,450 | * | 6/1987 | Krajacich | 123/79 A |
| 4,827,882 | * | 5/1989 | Paul et al. | 123/79 A |
| 5,503,124 | * | 4/1996 | Wallis | 123/80 BA |
| 5,941,206 | * | 8/1999 | Smith et al. | 123/80 BA |

FOREIGN PATENT DOCUMENTS

| | | |
|---|---|---|
| 719 510 | 4/1942 | (DE) . |
| 31 08 813 | 9/1982 | (DE) . |
| 31 42 891 | 5/1983 | (DE) . |
| 2 223 800 | 4/1990 | (GB) . |
| 98/36158 | 8/1998 | (WO) . |

OTHER PUBLICATIONS

Valkenburgh, "Electric Valves," *Road & Track*, Jun. 1998, pp. 170–174.

* cited by examiner

*Primary Examiner*—Marguerite McMahon
*Assistant Examiner*—Jason Benton
(74) *Attorney, Agent, or Firm*—Kenyon & Kenyon

(57) ABSTRACT

An internal combustion engine having a plurality of cylinders, comprising a movably mounted distribution element, wherein the distribution element in a first configuration fluidly couples an intake portion of a first cylinder of the plurality of cylinders with a combustion chamber of the first cylinder, and wherein the distribution element in a second configuration fluidly couples the combustion chamber of the first cylinder with an exhaust portion of the first cylinder.

34 Claims, 28 Drawing Sheets

FIRING ORDER

| DESIGN | NUMBER OF CYLINDERS | NORMAL FIRING ORDER (EXAMPLES) |
|---|---|---|
|   IN-LINE | 4<br>5<br>6<br><br><br><br>8 | 1-3-4-2 OR 1-2-4-3<br>1-2-4-5-3<br>1-5-3-6-2-4 OR<br>1-2-4-6-5-3 OR<br>1-4-2-6-3-5 OR<br>1-4-5-6-3-2<br>1-6-2-5-8-3-7-4 OR<br>1-3-6-8-4-2-7-5 OR<br>1-4-7-3-8-5-2-6 OR<br>1-3-2-5-8-6-7-4 |
|   V-TYPE | 4<br>6<br><br>8 | 1-3-2-4<br>1-2-5-6-4-3 OR<br>1-4-5-6-2-3<br>1-6-3-5-4-7-2-8 OR<br>1-5-4-8-6-3-7-2 OR<br>1-8-3-6-4-5-2-7 |
|   HORIZONTALLY-OPPOSED | 4 | 1-4-3-2 |

ROTARY DISTRIBUTION SYSTEM INTERNAL COMBUSTION ENGINE

BACKGROUND OF THE INFORMATION

A conventional internal combustion engine has for each cylinder, one or two intake valves and one or two exhaust valves. In the normal combustion cycle, the intake valves open during the intake phase, the exhaust valves open during the exhaust phase and both sets of valves remain closed during the compression and combustion phases.

During the intake phase when the intake valve opens, the negative pressure in the combustion chamber created by the downward motion of the piston draws intake air from the intake manifold into the combustion chamber. Ideally, when the pressure in the intake manifold and the combustion chamber equalizes, the intake valves close to keep the maximum charge in the combustion chamber. However, after the intake valve for a particular cylinder closes the air in the intake manifold becomes stagnant until the beginning of the intake cycle for the next cylinder. In the initial stages of the intake cycle for the next cylinder, the intake valve opens and the stagnant air is initially drawn into the combustion chamber by exhaust scavenging during a brief time in the intake phase during which both the intake and exhaust valves are open. Then, after the exhaust valve is closed, the negative pressure effect takes over to bring the remainder of the charge into the combustion chamber via the intake valve. This overlap feature which is designed to create more volumetric efficiency at higher RPMs allows some raw fuel to escape into the exhaust manifold creating unwanted exhaust emissions.

Additionally, the combustion cycle in a conventional engine causes severe heating to the intake and exhaust valves causing undesirable hot spots in the combustion chamber. As a result, a conventional engine is required to use a richer fuel to air ratio to control combustion temperatures within the fuel's flash point. Thus fuel is used not only as an energy source, but also to cool the combustion chamber.

Moreover, the rapid opening and closing of the intake and exhaust valves in a conventional engine leads to vibration and noise in the engine head.

SUMMARY OF THE INVENTION

An internal combustion engine having a plurality of cylinders, comprising a movably mounted distribution element, wherein the distribution element in a first configuration fluidly couples an intake portion of a first cylinder of the plurality of cylinders with a combustion chamber of the first cylinder, and wherein the distribution element in a second configuration fluidly couples the combustion chamber of the first cylinder with an exhaust portion of the first cylinder.

An intake system for an internal combustion engine having a plurality of cylinders that fire in a predetermined order, comprising a first intake passage extending to an intake portion of a first cylinder of the plurality of cylinders, wherein the first cylinder fires first in the predetermined order a second intake passage extending from the intake portion of the first cylinder to an intake portion of a second cylinder of the plurality of cylinders, wherein the second cylinder fires immediately subsequent to the first cylinder in the predetermined firing order and a final intake passage extending from an intake portion of a final cylinder to the intake portion of the first cylinder, wherein the final cylinder fires last in the predetermined firing order.

Detailed Description

Figure 1:
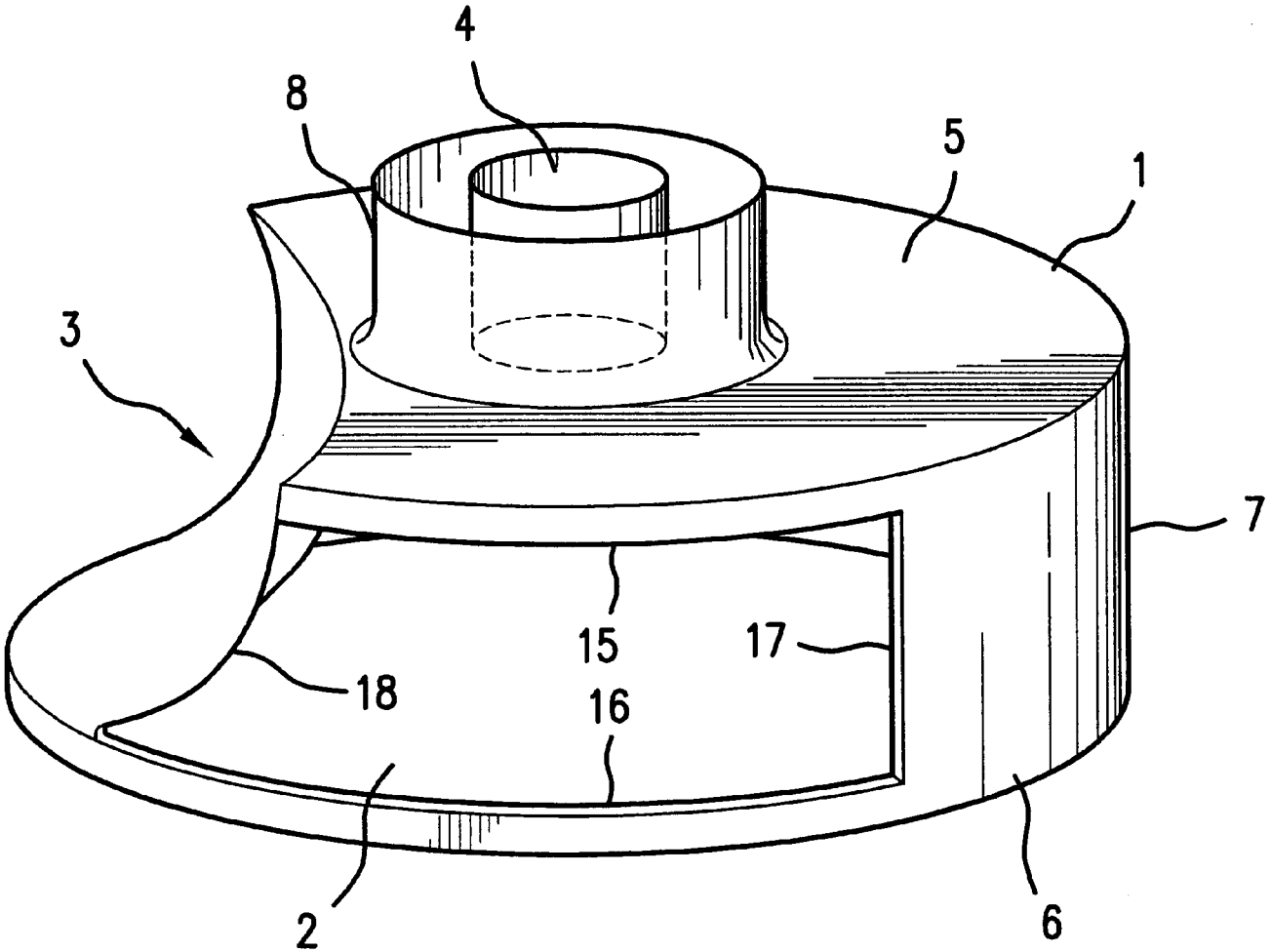
FIG. 1 shows an exemplary rotary distribution element according to the present invention.

The present invention may be further understood with reference to the following description and the appended drawings, wherein like elements are provided with the same reference numerals. In addition, it is noted that when terms such as top, bottom, horizontally and vertically are used, these terms are descriptive of an orientation relative to the drawings only and do not necessarily correspond to the horizontal and vertical in an actual engine in which these parts may be included.

FIG. 1 shows a rotary distribution element 1 according to a first embodiment of the present invention. The body of the rotary distribution element 1 has a generally cylindrical shape with a solid top 5 and an open bottom leading to a hollow inside cavity 6. The top of the rotary distribution element 1 includes a smaller cylindrical projection 8 having a valve guide 4 extending therethrough to the hollow inside cavity 6 of the rotary distribution element 1.

The wall 7 of the rotary distribution element 1 is preferably formed as a generally cylindrical surface except for two features of interest in the present invention. First, there is an opening port 2 providing a via from the outside of the rotary distribution element 1 to the hollow inside cavity 6. Secondly, an indentation 3 is formed in wall 7. The indentation 3 is preferably formed generally in the shape of an arc running from the bottom to the top of wall 7 and is preferably substantially smooth to allow for free air flow over the surface of the indentation 3. The opening port 2 and indentation 3 are preferably arranged adjacent to one another in wall 7. Opening port 2 has a generally rectangular shape with two sides 15, 16 running horizontally and parallel along wall 7, a third side 17 running vertically along wall 7 and a fourth side 18 running up wall 7 along a contour of the indentation 3, such that one of the two horizontal sides 16 is longer than the other. The purpose of the opening port 2 and indentation 3 will be described in more detail below.

Figure 2:
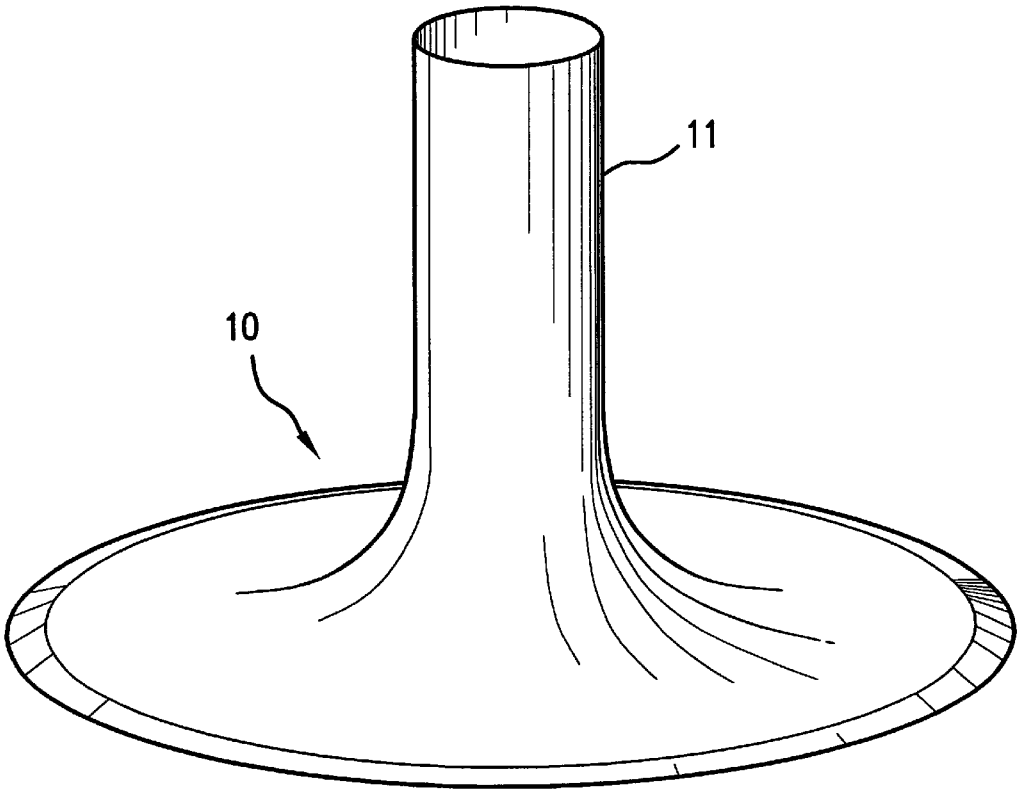
FIG. 2 shows a poppet valve.

FIG. 2 shows a poppet valve 10 for use in the cylinder head. Because of the arrangement of the present invention, a single poppet valve may serve as both the intake and exhaust valve in each cylinder head. Poppet valve 10 has a valve stem 11 which is slidably inserted in valve guide 4 in order to allow movement of the valve stem along a longitudinal axis, while restricting movement along the radial axis. The operation of poppet valve 10 will be described in more detail below.

Figure 3:
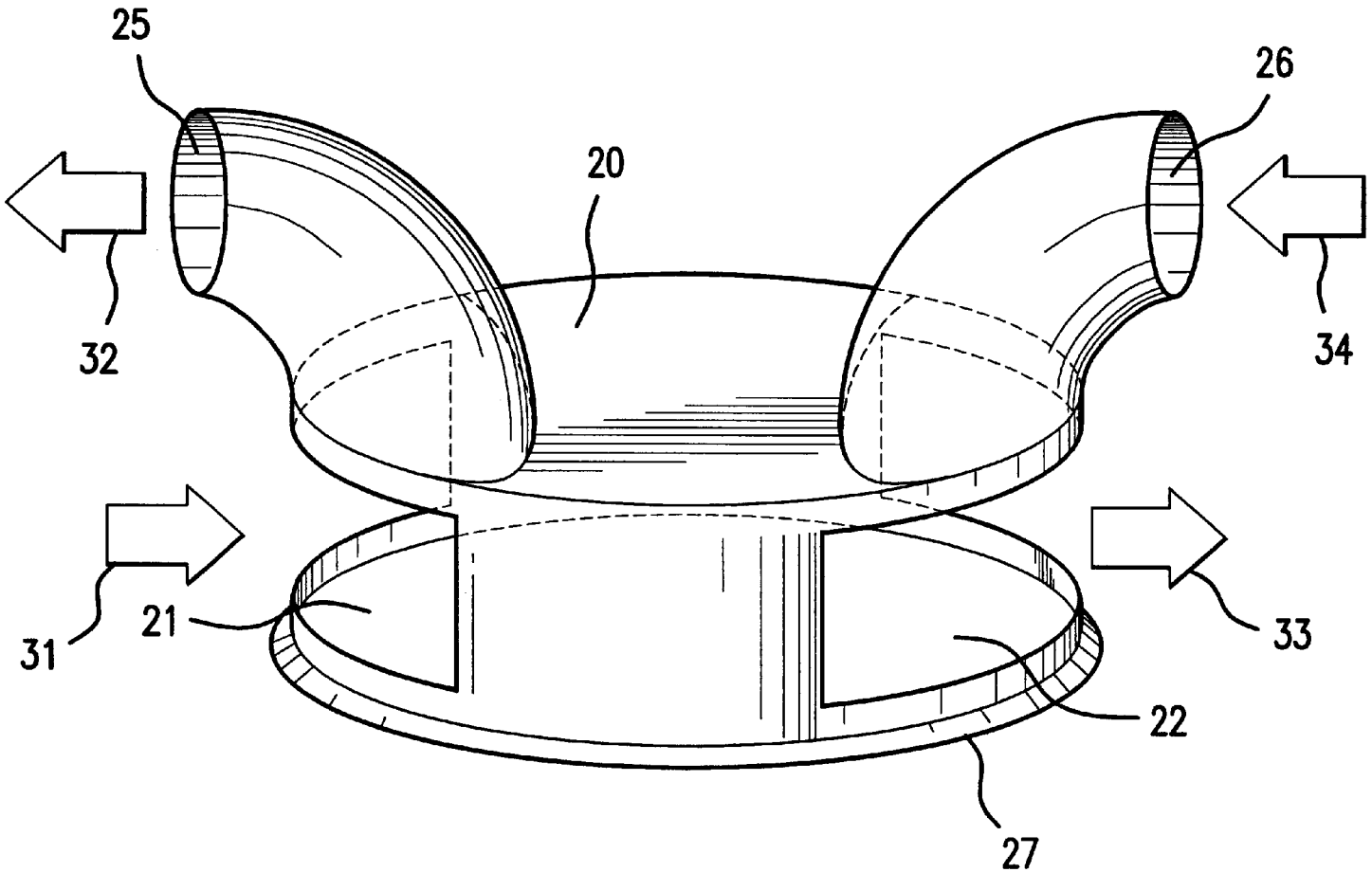
FIG. 3 shows an exemplary engine cylinder head according to the present invention.

FIG. 3 shows an engine cylinder head 20 according to the present invention. The cylinder head 20 has an intake port 21 and an exhaust port 22. The bottom of cylinder head 20 has a valve seat 27 for valve 10. The top of the cylinder head 20 includes an intake air bypass 25 and an exhaust fresh air supply port 26. In FIG. 3 the intake air bypass 25 and exhaust fresh air supply port 26 are shown in an exemplary manner as portions of a manifold allowing air flow in the direction of arrows 31–34. It should be understood that the structure for these elements shown in FIG. 3 is not critical. The criticality of these features is that they allow air flow in the direction of the arrows 31–34. Thus, the intake air bypass 25 and the exhaust fresh air supply port 26 may, for example, alternatively be formed as vias in the top of cylinder head 20 to allow air flow therethrough.

The arrows 31–34 in FIG. 3 show the direction of air flow into and out of cylinder head 20. Air flows into intake port 21 in the direction of arrow 31 and, when the indentation 3 is aligned with the intake port 21, as explained in more detail below, flows out intake air bypass 25 in the direction of arrow 32. After combustion is complete in the engine cylinder, the exhaust gas flows out through exhaust port 22 in the direction of arrow 33. The exhaust gas flowing out through exhaust port 22 is mixed with fresh air supplied by fresh air supply port 26 in the direction of arrow 34.

Figure 4:
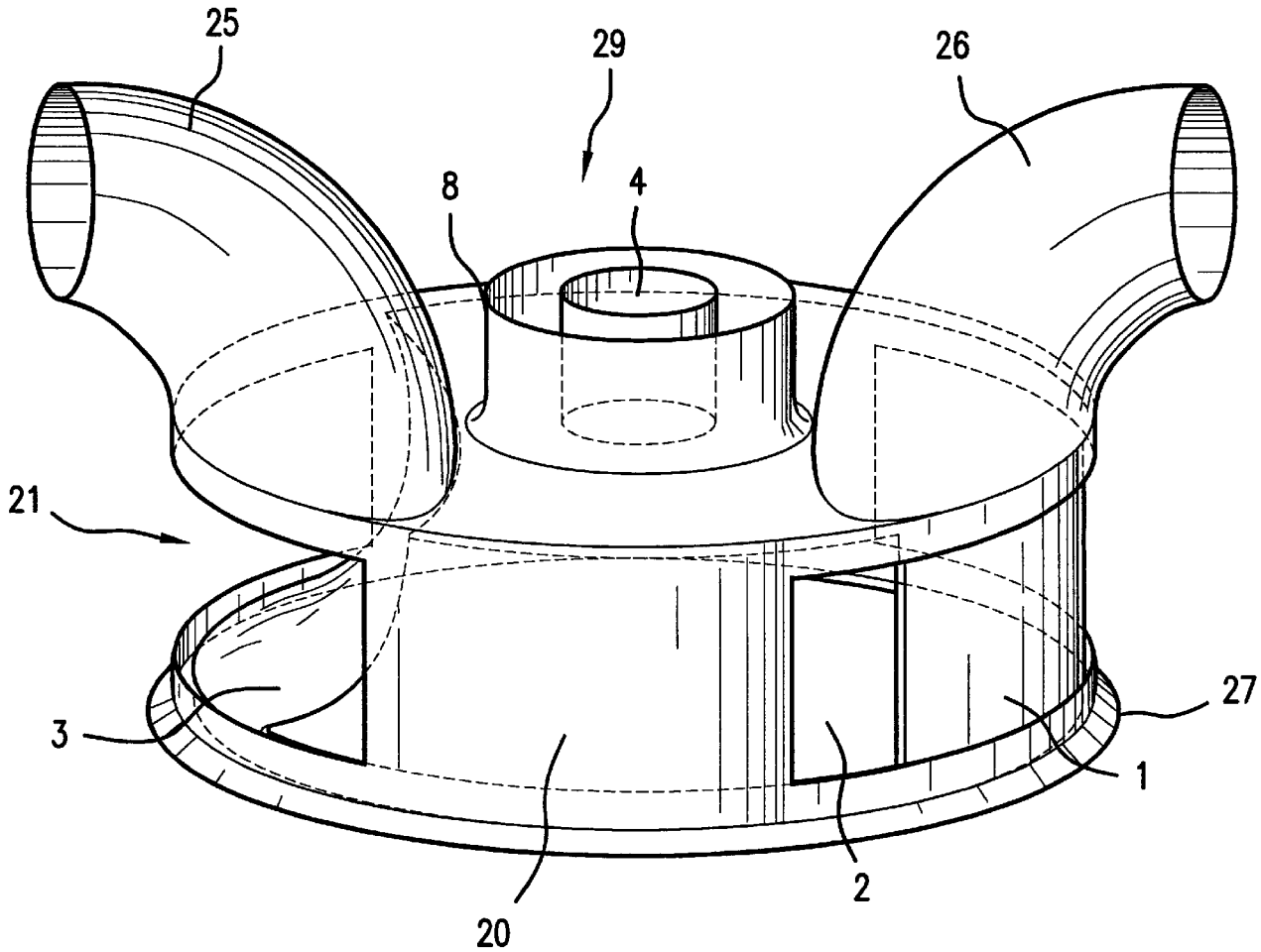
FIG. 4 shows an exemplary engine cylinder head assembly including the exemplary rotary distribution element disposed in the exemplary engine cylinder head according to the present invention.

FIG. 4 shows the cylinder head assembly 29 with the rotary distribution element 1 disposed in cylinder head 20. Those skilled in the art will understand that the shape of cylinder head 20 is not critical to the present invention as long as it includes a hollow center portion rotatably accommodating the rotary distribution element 1. As can be seen from FIG. 4, the rotary distribution element 1 is received inside cylinder head 20 such that it can be rotated at high speeds therein. Those skilled in the art will also understand that friction between the rotary distribution element 1 and the cylinder head 20 can be reduced in a number of known manners. For example, by lubrication with motor oil or by using a high cycle sealed bearing.

Combustion Cycle

Figure 5:
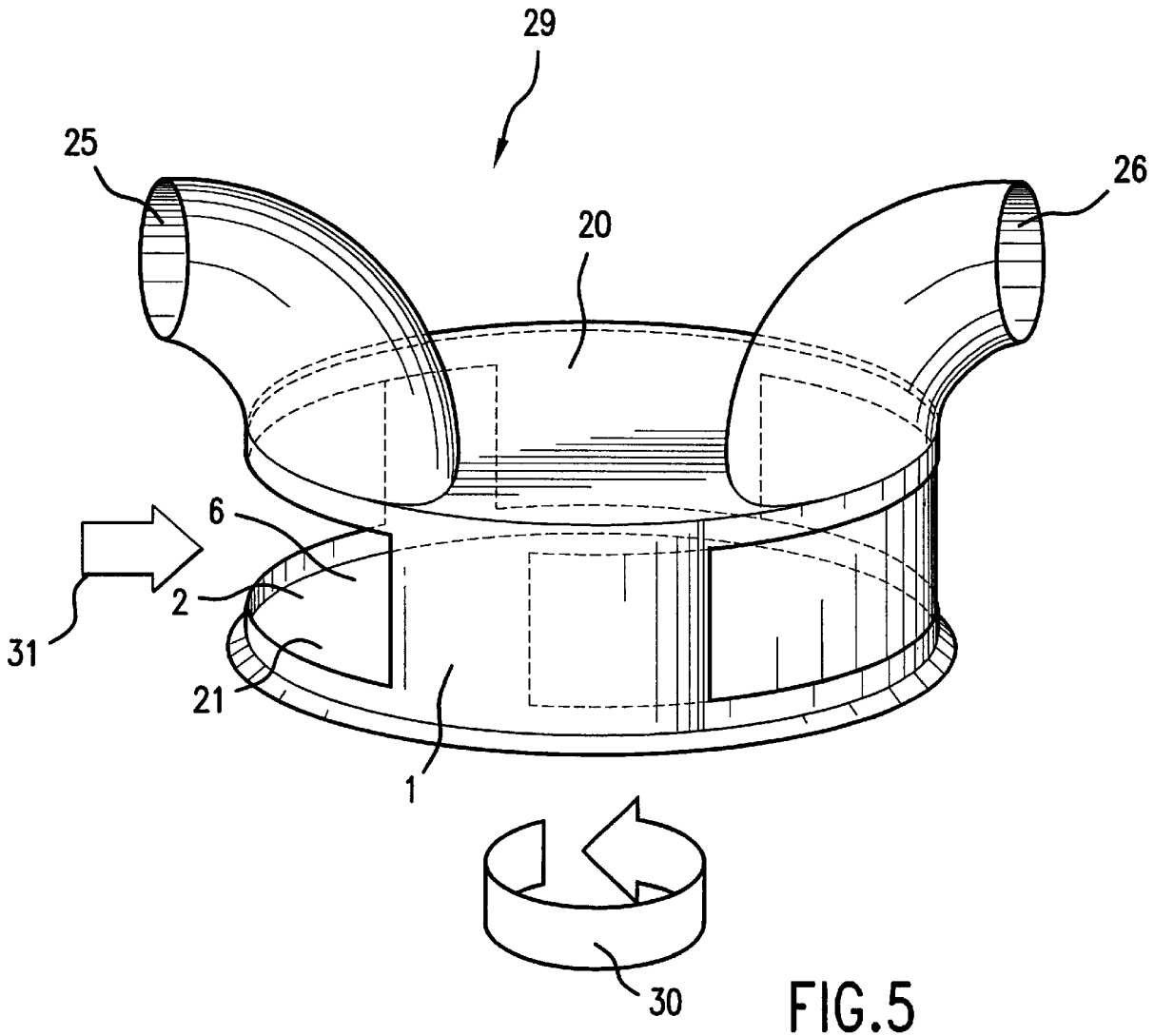
FIG. 5 shows the exemplary engine cylinder head assembly arranged so that the intake port is open according to the present invention.

The following will explain the operation of rotary distribution element 1 during the combustion cycle of the cylinder. FIG. 5 is similar to FIG. 4 in that it shows the cylinder head assembly 29, except that the protrusion 8 including the valve guide 4 of the rotary distribution element 1 is not shown. Rotary distribution element 1 rotates, e.g., in a counter-clockwise direction as shown by arrow 30. FIG. 5 illustrates the intake phase of the combustion cycle when intake air is admitted to the cylinder head assembly 29. In FIG. 5 the opening port 2 of rotary distribution element 1 is aligned with intake port 21 of cylinder head 20, allowing intake air for combustion to flow in the direction of arrow 31 into the hollow inside cavity 6 and, although the valve 10 is not shown in FIG. 5, those skilled in the art will understand that the opening of the valve 10 will be synchronized with the rotation of the rotary distribution element 1 so that, when the opening port 2 and the intake port 21 are aligned the cavity 6 is open to the combustion chamber. Of course, those skilled in the art will understand that the movement and synchronization of the rotary distribution element 1 and the valve 10 can be controlled by any known mechanical or electronic means, for example, a timing chain and gearing mechanism coupled to the drive shaft or under computer control of electronic devices such as solenoids, etc. It should be understood that the intake air described above may be either air or an air-fuel mixture, depending on the type of injection used by the engine and the present invention can be adapted for use with any type of fuel injection system (e.g. direct, semi-direct, indirect). Additionally, after admission of the intake air into the hollow inside cavity 6, the air must then be admitted into the main combustion chamber for actual combustion to occur. Admission into the main combustion chamber is controlled using poppet valve 10 from FIG. 2, and will be explained in greater detail below.

Figure 6:
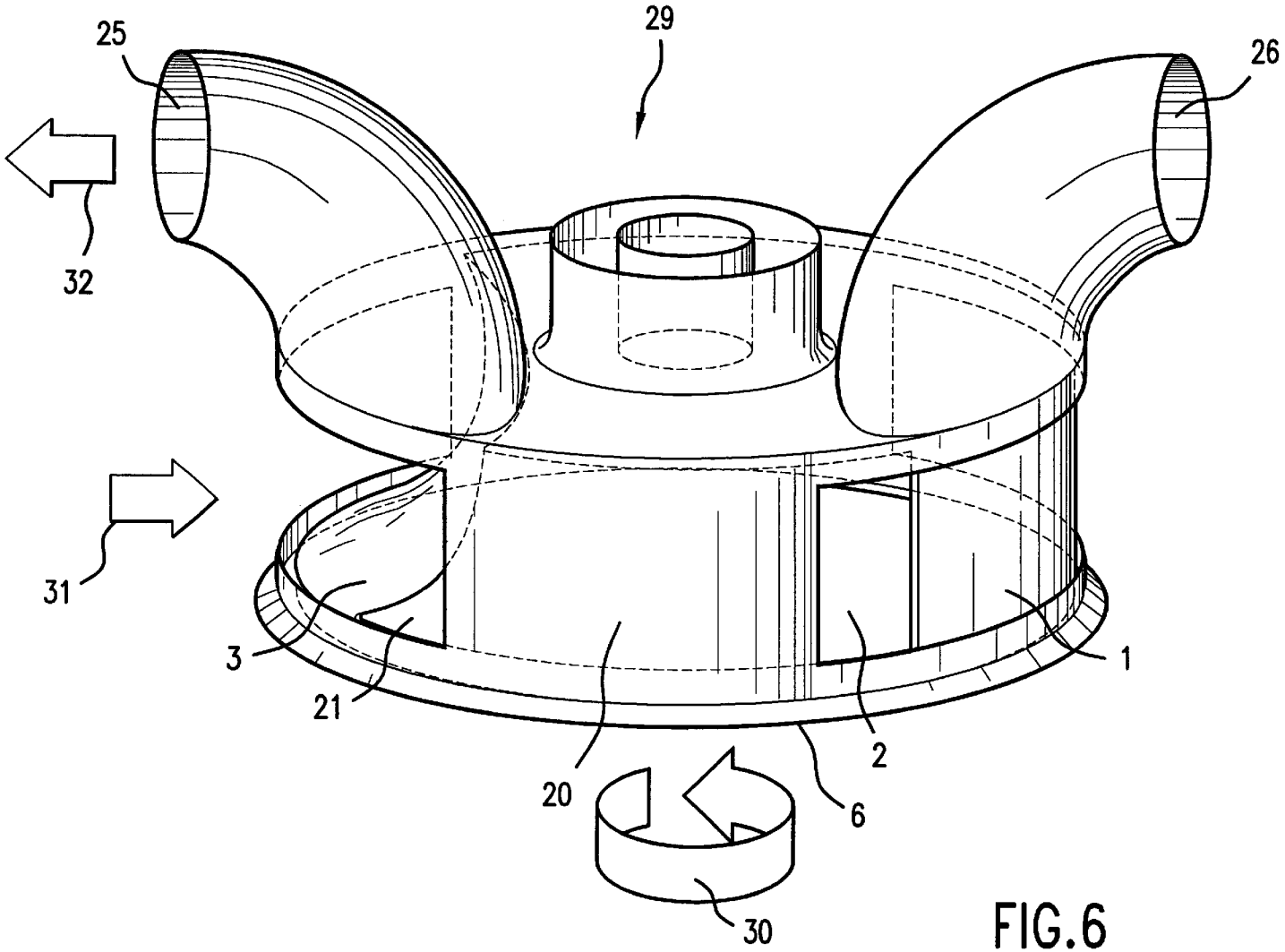
FIG. 6 shows the exemplary engine cylinder head assembly arranged so that intake air bypasses the cylinder head assembly according to the present invention.

FIG. 6 shows the position of the rotary distribution element 1 immediately after the intake phase is finished. Rotary distribution element 1 has rotated in the counter-clockwise direction, as shown by arrow 30, such that opening port 2 is no longer aligned with intake port 21. At this time, no more intake air can enter hollow inside cavity 6. In FIG. 6, indentation 3 is aligned with intake port 21 of cylinder head 20, thus the air flowing in the direction of arrow 31 flows over indentation 3 and is redirected up and out of intake air bypass 25 in the direction of arrow 32. Using this arrangement, the velocity of intake air built up in the direction of arrow 31 during the intake stroke is redirected in direction of arrow 32 with little or no loss of air velocity. The purpose of this redirection of air flow will be explained in greater detail below.

Figure 7:
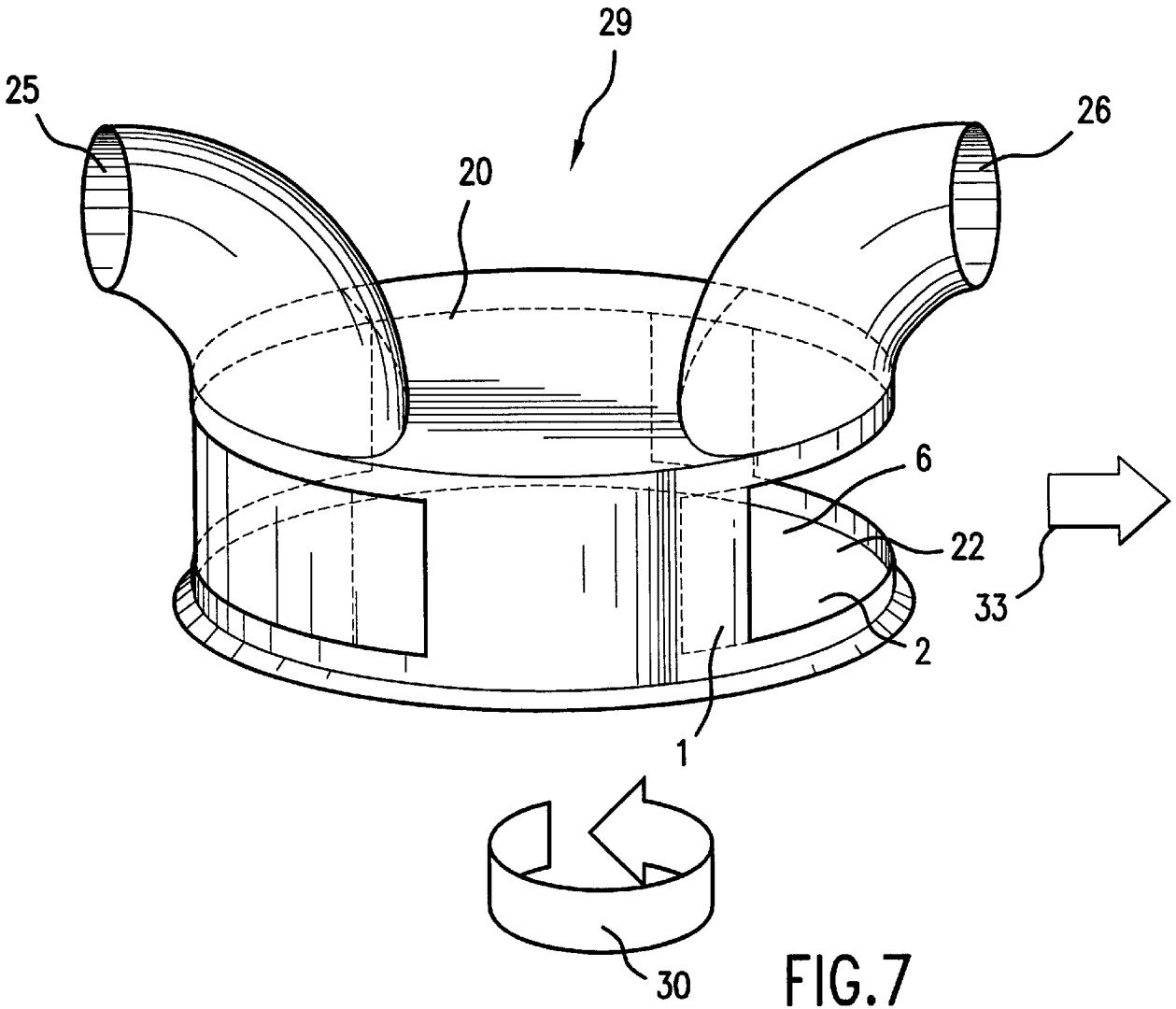
FIG. 7 shows the exemplary engine cylinder head assembly arranged so that the exhaust port is open according to the present invention.

FIG. 7 illustrates the exhaust phase of the combustion cycle. In FIG. 7, the rotary distribution element 1 has rotated further in the direction of arrow 30, such that opening port 2 is aligned with exhaust port 22 of cylinder head 20. During the exhaust phase of the combustion cycle, poppet valve 10 (not shown) has opened to admit exhaust gas from the main combustion chamber into hollow inside cavity 6. The alignment of opening port 2 and exhaust port 22 allows the exhaust gas to flow out of the cylinder head assembly 29 through the cavity 6 in the direction of arrow 33.

Figure 8:
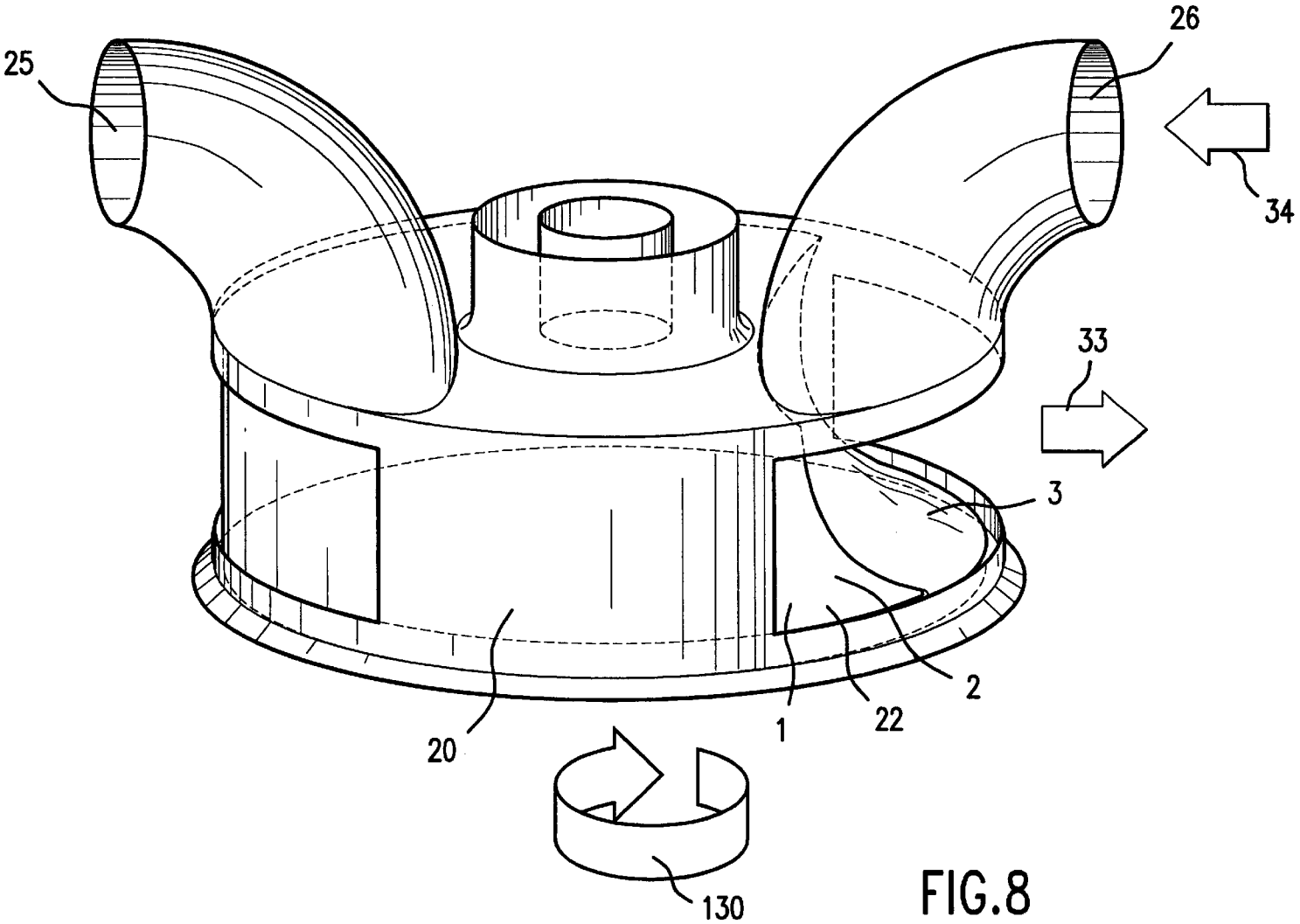
FIG. 8 shows the exemplary engine cylinder head assembly arranged so that the exhaust port is supplied with fresh air according to the present invention.

FIG. 8 shows the position of the rotary distribution element 1 in the latter stages of the exhaust phase. It should be noted that in FIG. 8, rotary distribution element 1 is shown with indentation 3 and opening port 2 reversed from the previous figures. It should be understood that the rotation of the rotary distribution element 1 in the counter-clockwise direction as depicted by arrow 30 in the previous figures is merely exemplary. Based on this altered arrangement in FIG. 8, the rotary distribution element 1 can just as easily be rotated in the clockwise direction as depicted by arrow 130.

In FIG. 8, rotary distribution element 1 has rotated in the direction of arrow 130, such that opening port 2 is no longer aligned with exhaust port 22. In FIG. 8, indentation 3 is aligned with exhaust port 22 of cylinder head 20, thus allowing fresh air flowing in through fresh air supply port 26 in the direction of arrow 34 to flow over indentation 3 and be redirected in the direction of arrow 31. This fresh air cools rotary distribution element 1 and lowers the exhaust emissions by supplying oxygen to the exhaust gas.

Figure 9:
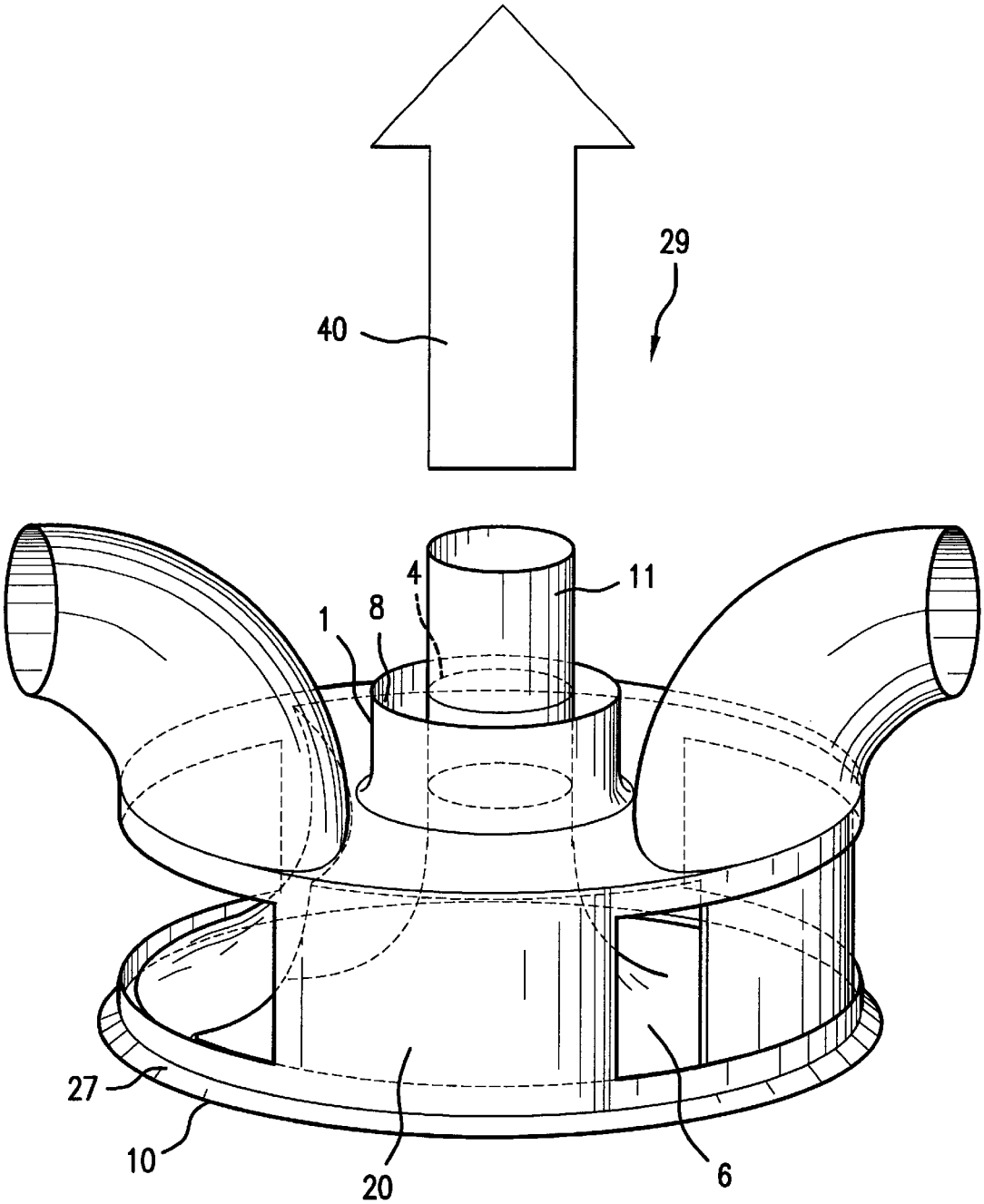
FIG. 9 shows the exemplary engine cylinder head assembly with the poppet valve inserted and moved to its seated position according to the present invention.
Figure 10:
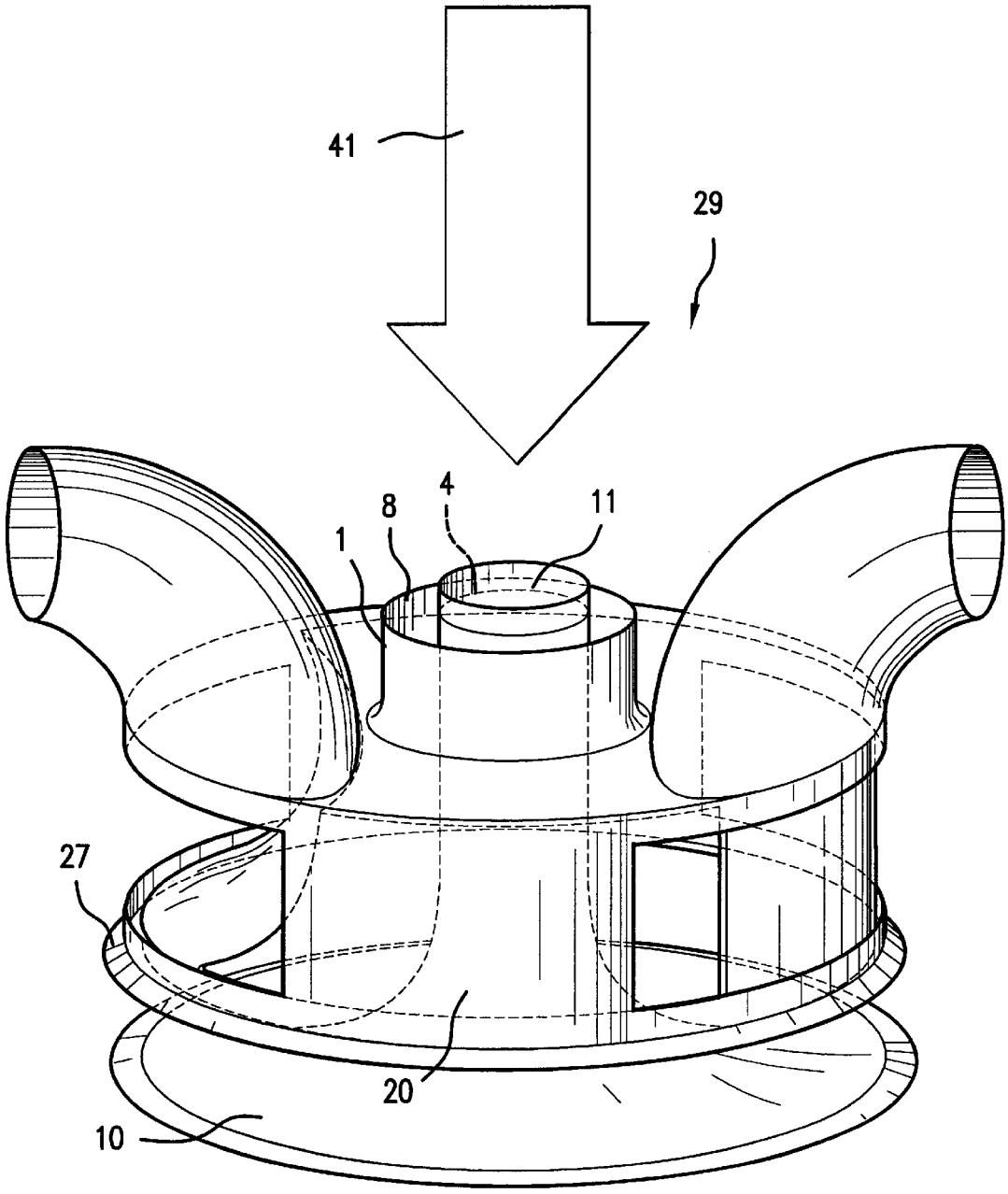
FIG. 10 shows the exemplary engine cylinder head assembly with the poppet valve inserted and moved to its open position according to the present invention.

FIGS. 9 and 10 show the cylinder head assembly 29 according to the present invention with poppet valve 10 inserted into the assembly. Poppet valve 10 is shown with the valve stem 11 inserted through the valve guide 4 of rotary distribution element 1, allowing the valve to move along the longitudinal axis thereof. As shown in FIG. 9, the poppet valve 10 can move upward along the longitudinal axis as depicted by arrow 40, and in FIG. 10, valve 10 can move downward along the longitudinal axis as depicted by arrow 41. As shown in FIG. 9, when poppet valve 10 is moved upward, it will seat against valve seat 27 of cylinder head 20 to seal the hollow inside cavity 6 from the main combustion chamber (not shown) which is below the cylinder head assembly 29. In FIG. 10, poppet valve 10 is moved downward away from valve seat 27, thus allowing free passage from the hollow inside cavity 6 to the main combustion chamber (not shown). Based on the phase of the combustion cycle the engine cylinder is in, opening poppet valve 10 will either allow intake air to flow from the hollow inside cavity 6 into the main combustion chamber or will allow exhaust gas to flow from the main combustion chamber to the hollow inside cavity 6. A unique feature of the present invention is that the poppet valve 10 may remain open during the entire intake phase and then during the entire exhaust phase of the combustion cycle. Since the poppet valve 10 opens and closes less often than in conventional engines, the valves according to the present invention are less prone to vibration and noise than in a conventional engine. It should be understood that references to the upward and downward directions above are only exemplary, and that the cylinder head assembly does not need to be oriented in a vertical direction, but can be oriented in any direction (e.g. vertical, slanted, horizontal).

Exemplary Embodiments

Figure 11:
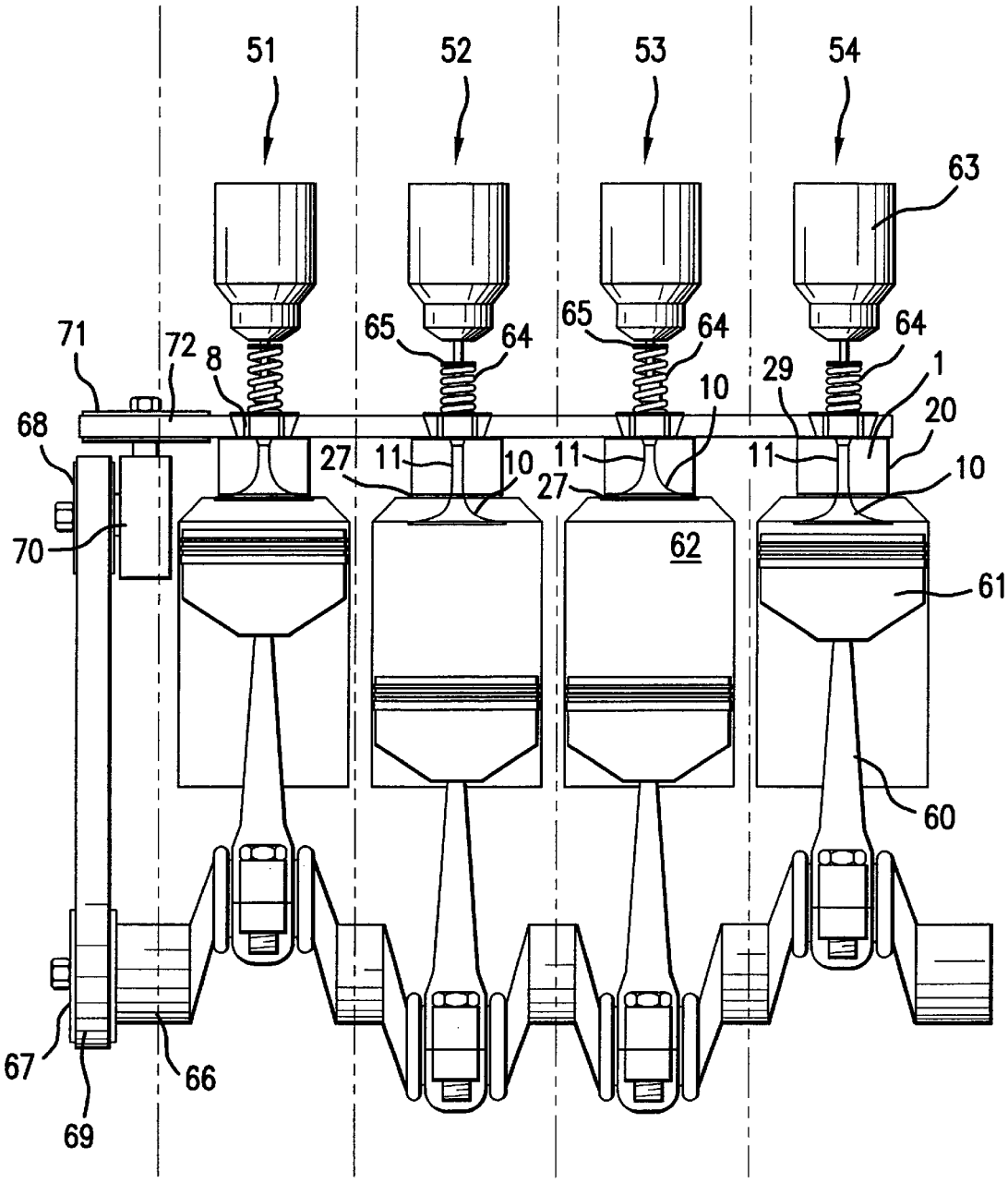
FIG. 11 shows a typical four cylinder engine with an exemplary belt drive assembly for the rotary distribution elements according to the present invention.

FIG. 11 shows an exemplary embodiment of the present invention in a four cylinder engine. Cylinders 51–54 are shown between the dashed lines in FIG. 11. Each of the cylinders includes a connecting rod 60, a piston 61, a main combustion chamber 62 and a cylinder head assembly 29. Each cylinder head assembly 29 has the above described rotary distribution element 1 disposed in cylinder head 20 with poppet valve 10. In the exemplary embodiment shown in FIG. 11, poppet valve 10 is a solenoid controlled valve. Each of the solenoids 63 controls the actuation of the corresponding poppet valve 10 in conjunction with a respective valve spring 64. Cylinder 52 illustrates the action of poppet valve 10 when solenoid 63 is actuated. When solenoid 63 is actuated, plunger 65 compresses valve spring 64 and pushes on valve stem 11, thereby unseating poppet valve 10 from valve seat 27. Poppet valve 10 in its open position allows intake air or exhaust gas to flow between the main combustion chamber 62 and the cylinder head assembly 29 depending on the position of the rotary distribution element 1. Cylinder 53 illustrates the action of poppet valve 10 when solenoid 63 is not actuated. No pressure is exerted by solenoid 63 on plunger 65, thus valve spring 64 remains in its extended state and pulls on valve stem 11, thereby seating poppet valve 10 against valve seat 27. When poppet valve 10 is in its seated (closed) position it isolates the main combustion chamber 62 from the cylinder head assembly 29.

In the past solenoid type controls have been used for poppet valves, however the valve speeds were often too fast to allow full control using a solenoid. For example, in a conventional engine operating at 6000 RPM, each poppet valve has to operate approximately 50 times per second. In an engine according to the present invention operating at the same speed, each poppet valve would only be required to operate 25 times per second as the poppet valve 10 remains open during the complete intake and exhaust phases. Additionally, the compressing of the air during the compression phase in combination with the above-described arrangement will aid in slamming the poppet valve 10 shut. This causes less stress on the solenoid allowing it to last longer. Poppet valve 10 also has a larger surface area than traditional exhaust valves. This larger surface area allows exhaust gas to escape more easily, thereby heating the valve less and avoiding the forming of undesirable hot spots in the combustion chamber. This allows an engine according to the present invention to use a leaner air/fuel mixture than that suitable for conventional engines.

FIG. 11 also demonstrates one exemplary method of providing energy to rotate the rotary distribution elements 1 that are part of the cylinder head assembly 29. In FIG. 11, the connecting rods 60 of each of the pistons 61 is attached to a crank shaft 66. At one end of crank shaft 66 is a drive pulley 67 that rotates as the crank shaft 66 turns. The drive pulley 67 is attached by a drive belt 69 to a second drive pulley 68. The rotation of the first drive pulley 67 is imparted to the second drive pulley 68 by the drive belt 69. Drive pulley 68 is attached to a differential 70 which is also attached to a third drive pulley 71. The differential 70, normally through a series of gears, imparts the motion of the first pulley system, drive pulleys 67,68, to drive pulley 71. Attached to drive pulley 71 is drive belt 72 which extends around all the cylinders 51–54. Drive belt 72 is attached either directly to each of the protrusions 8 of rotary distribution elements 1 or by an assembly (not shown) that is connected to the protrusions 8. The turning of drive pulley 71 is thereby imparted to the rotary distribution elements 1 by drive belt 72. In this manner, the rotary distribution element 1 of each cylinder is rotated within the cylinder head 20 to operate in the manner described above. Differential 70 controls the speed of rotation of the rotary distribution elements 1 relative to the rotational speed of the crank shaft 66.

Figure 12:
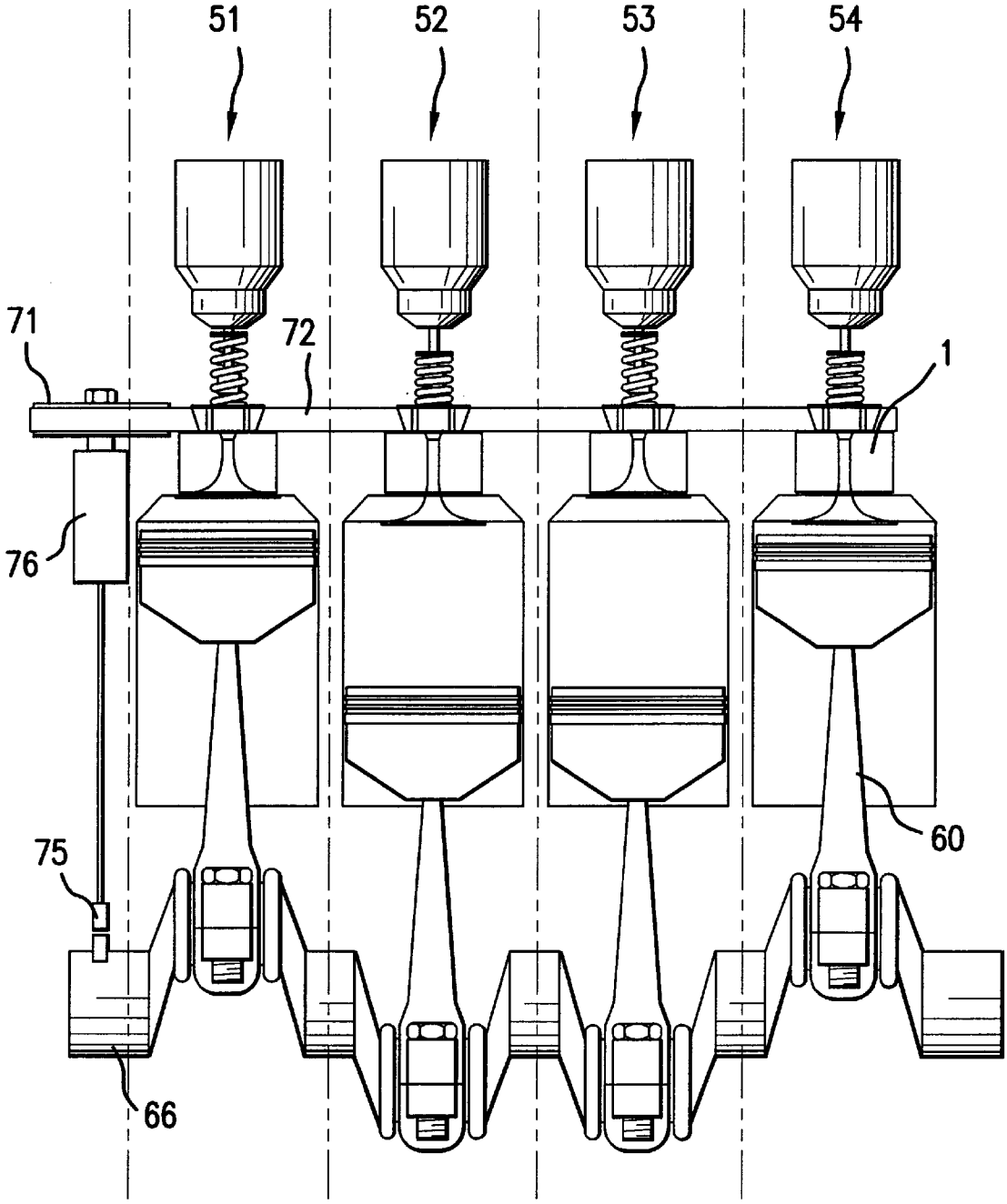
FIG. 12 shows a typical four cylinder engine with an exemplary electric drive assembly for the rotary distribution elements according to the present invention.

FIG. 12 demonstrates a second exemplary manner of providing energy to rotate the rotary distribution elements 1 that are part of the cylinder head assembly 29. The cylinders 51–54 in FIG. 12 are exactly the same as those in FIG. 11. However, instead of a drive pulley at the end of crank shaft 66, there is a crankshaft position sensor 75. The crankshaft position sensor 75 senses the position and the rate of rotation of the crank shaft 66 and transmits an electrical signal containing this information to an electric motor 76. Attached to the rotor of electric motor 76 is a drive pulley 71 (same as FIG. 11). Similar to FIG. 11, drive pulley 71 is attached via drive belt 72 to the rotary distribution element 1 of each of the cylinders 51–54. Based on the signal from crankshaft position sensor 75, electric motor 76 rotates drive pulley 71 at a desired speed relative to the speed of rotation of the crankshaft 66 and through drive belt 72 each of the rotary distribution elements 1 are rotated.

Figure 13:
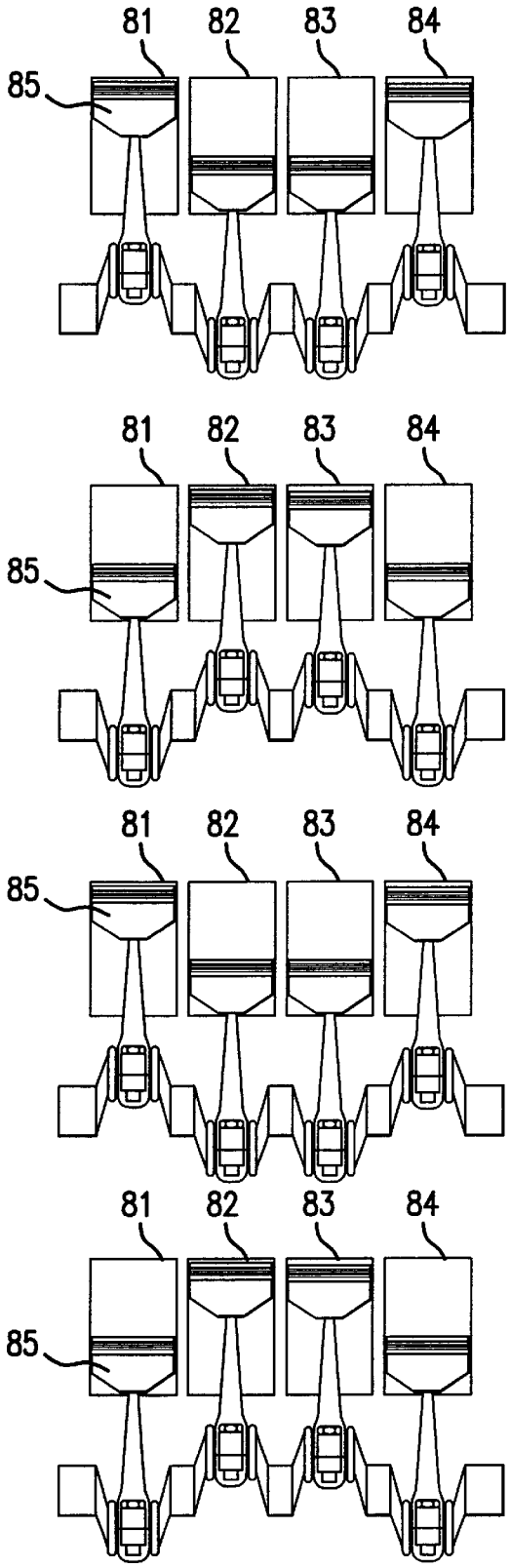
FIG. 13 shows the typical piston action in the main combustion chamber during the combustion cycle of a typical in-line four-cycle, four cylinder engine.

FIG. 13 shows the piston action in the main combustion chamber during the combustion cycle for a typical in-line four-cycle, four cylinder engine. Those skilled in the art will understand that this arrangement is exemplary only and that the present invention may be employed in any multi cylinder engine. Although cylinders 81–84 are shown in FIG. 13, the piston action will be described with reference only to cylinder 81 containing piston 85. In the first drawing in FIG. 13, piston 85 is at its uppermost position in the main combustion chamber illustrating the end of the compression phase. During the compression phase (as piston 85 moved toward its uppermost position) the air-fuel mixture in the main combustion chamber was compressed and a spark plug (not shown) was fired, thereby igniting the air-fuel mixture. This ignition of the air-fuel mixture caused gas expansion in the combustion chamber forcing the piston 85, during the combustion phase, downward from its uppermost position to its lowermost position as shown in the second drawing of FIG. 13. When piston 85 is in its lowermost position after the combustion phase, the combustion chamber is filled with exhaust gas from the preceding combustion. Therefore piston 85 is moved back toward its uppermost position to force the exhaust gas out of the combustion chamber during the exhaust phase and, as described above, the valve 10 is open and the rotary distribution element 1 is aligned to communicate the combustion chamber 62 and the cavity 6 with the exhaust port 22. The third drawing of FIG. 13 illustrates the position of piston 85 at the end of the exhaust phase when the movement of piston 85 to its uppermost position has forced all the exhaust gas out of the combustion chamber. Finally, the combustion chamber must be supplied with a new air-fuel mixture for a new combustion to take place. Therefore piston 85 moves from its uppermost position to its lowermost position during the intake phase drawing the air-fuel mixture into the combustion chamber as the valve 10 is open and the rotary distribution element 1 is aligned to communicate the combustion chamber 62 and the cavity 6 with the intake port 21. The movement of piston 85 towards its lowermost position during the intake phase causes negative pressure in the combustion chamber, thereby drawing in the air-fuel mixture into the area of low pressure. The final drawing of FIG. 13 illustrates the position of piston 85 and the end of the intake phase. At this point the combustion cycle is repeated starting with the compression phase as described above.

The combustion cycles for the other cylinders 82–84 work in the same manner, except that the timing will be different. For example, as shown in the final drawing of FIG. 13, when cylinder 81 is at the end of the intake phase, cylinder 82 is at the end of the compression phase, cylinder 83 is at the end of the exhaust phase and cylinder 84 is at the end of the combustion phase. In this example, the firing order of the cylinders is said to be 1–3–4–2. This means cylinder 81 will fire first, cylinder 83 will fire second, cylinder 84 will fire third, cylinder 82 will fire last, and then the whole sequence will be repeated.

Figure 14:
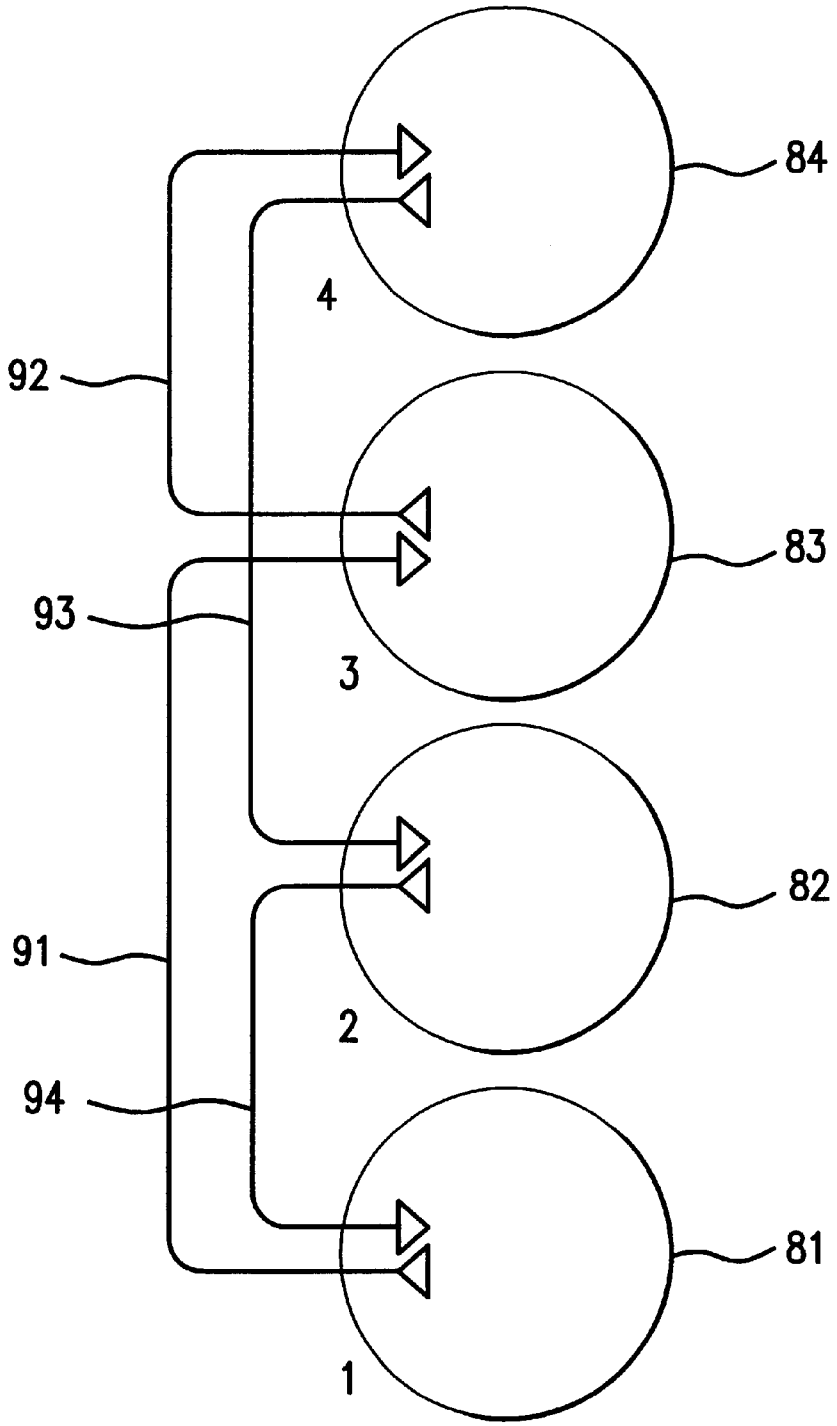
FIG. 14 shows a schematic of a typical firing order of a typical in-line four-cycle, four cylinder engine.

FIG. 14 shows a schematic of the four cylinders 81–84 from FIG. 13 having the same exemplary firing order, i.e. 1–3–4–2, as described above. The lines with arrows 91–94 in FIG. 14 represent the intake air flow to each of the cylinders. The intake phase of combustion occurs in the same order, i.e. 1–3–4–2, as the firing order. Therefore, intake air will initially flow into cylinder 81, then air flow into cylinder 81 is cut-off at the end of the intake phase, the intake air flow is diverted by the interposition of the indentation 3 from cylinder 81 to cylinder 83 (line 91), then from cylinder 83 to cylinder 84 (line 92), then from cylinder 84 to cylinder 82 (line 93), and finally from cylinder 82 back to cylinder 81 (line 94). As described above with reference to FIG. 6, at the end of the intake phase, indentation 3 of rotary distribution element 1 is aligned with intake port 21 of cylinder head 20 allowing the air flow in direction of arrow 31 to flow over indentation 3 and out intake air bypass 25 in the direction of arrow 32 without a substantial decrease in the velocity of air flow.

As described previously, in a conventional engine when an intake valve is initially opened, the intake air has a zero or very low velocity, thus the air is drawn into the combustion chamber by a combination of exhaust scavenging during the overlap when the intake and exhaust valves are open and by the negative pressure created by the piston action. However as described above, using the rotary distribution element 1 it is possible to deliver intake air at significant velocities (~100 m/s) to each cylinder during the intake phase. The speeding air directed into each combustion chamber causes a ram air charge effect and in combination with the negative pressure created by the piston causes the combustion chamber to be charged to its full potential. Charging the combustion chamber to its full potential can elevate the horsepower achieved by the engine over a conventional intake system. Additionally, this ram air rushing into the combustion chamber cools poppet valve 10 considerably, minimizing undesirable hot spots in the combustion chamber.

For example, with reference to FIG. 14, after the intake phase is complete for cylinder 81, the intake air is redirected using the rotary distribution element towards cylinder 83, the next cylinder to enter the intake phase, along line 91. Similarly, after the intake phase of cylinder 83 is complete, the intake air is redirected towards cylinder 84, the next cylinder to enter the intake phase, along line 92, until the intake air returns to cylinder 81 and the whole process is repeated. Of course, there must be a physical structure to take the air directed out of the intake air bypass 25 and direct it towards the next cylinder. To this end, a manifold system has been developed, that can deliver intake air along the paths described by lines 91–94 in FIG. 14. The manifold positioning will be described in greater detail below.

Figure 15:
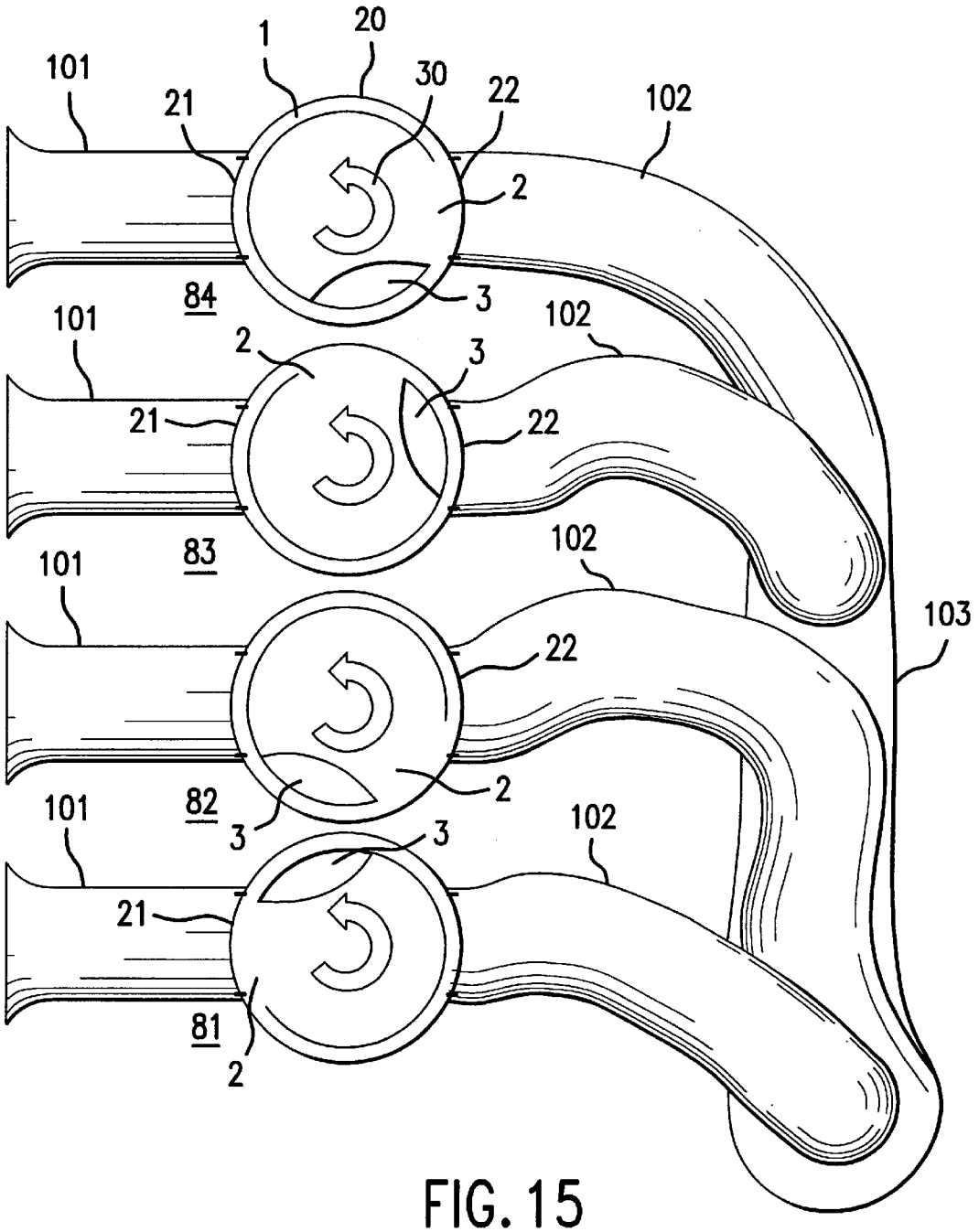
FIG. 15 shows a cross-sectional top view of an exemplary in-line four-cylinder engine according to the present invention.

FIG. 15 depicts an in-line four-cycle, four cylinder engine having cylinders 81–84 having a plurality of rotary distribution elements 1 disposed in the cylinder head 20. However, the protrusions 8 are not shown. Arrow 30 shows the counter-clockwise rotation of the rotary distribution elements 1. In this exemplary embodiment, the firing order of the cylinders, i.e. 1–3–4–2, remains the same as described above. Cylinder 81 is in the intake phase with opening port 2 aligned with intake port 21. Cylinder 83 is in the final stage of the exhaust phase where indentation 3 is aligned with exhaust port 22 to allow fresh air to be mixed with the exhaust gas. As can be seen from FIG. 15, as rotary distribution element 1 of cylinder 83 rotates, it will be the next cylinder to enter the intake phase, where opening port 2 will align with intake port 21. Cylinder 84 is in the exhaust phase where opening port 2 is aligned with exhaust port 22 to allow exhaust gas to flow out of cylinder 84. Cylinder 82 is in the combustion phase, since its opening port 2 is not yet aligned with exhaust port 22.

In addition to the cylinders 81–84, FIG. 15 also depicts a portion of the manifold assembly. Portions of intake air manifolds 101 are shown leading to the intake port 21 of each of the cylinders 81–84. Exhaust gas manifolds 102 are shown leading away from exhaust port 22 of each of the cylinders 81–84. Exhaust gas manifolds 102 lead to a common exhaust gas header 103.

Figure 16:
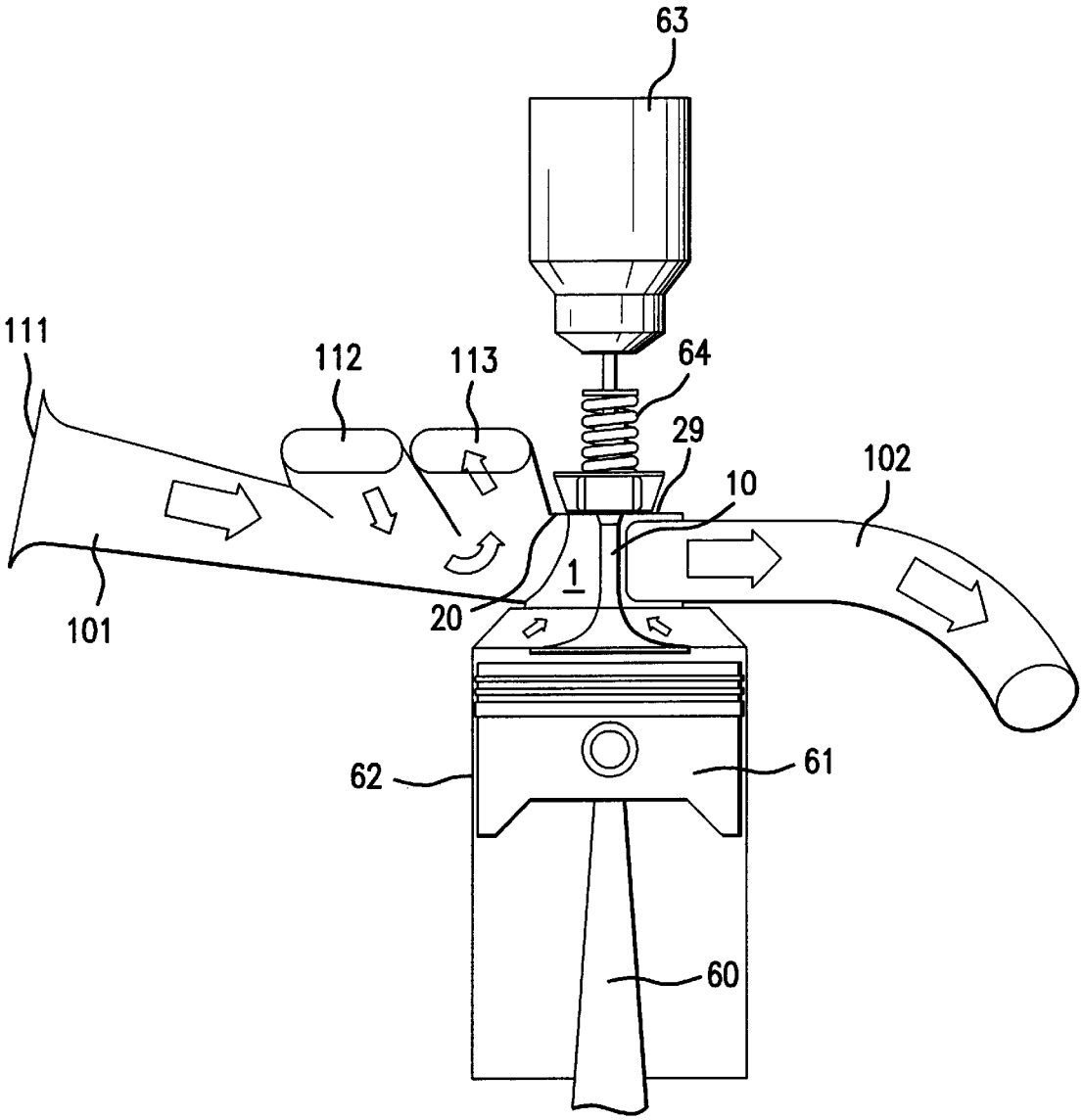
FIG. 16 shows a side view of an exemplary engine cylinder according to the present invention.

FIG. 16 shows a side view of a single cylinder including the intake air and exhaust manifolds. The cylinder, again, includes a connecting rod 60, a piston 61, a main combustion chamber 62 and a cylinder head assembly 29. The cylinder head assembly 29 includes the rotary distribution element 1 disposed in cylinder head 20 and a poppet valve 10 inserted therethrough. Poppet valve 10 is controlled, for example, by solenoid 63 and valve spring 64. Intake air manifold 101 combines air taken in through port 111 with the recirculated air described above which is delivered via port 112 and delivers it to the intake port 21 of the cylinder. When the intake port 21 of the cylinder head 20 and the opening port 2 of the rotary distribution element 1 are aligned (See FIG. 5) and the valve 10 is open the ram jet intake air enters the cylinder to completely charge the main combustion chamber 62. When the intake port 21 of the cylinder head 20 and the indentation 3 of the rotary distribution element 1 are aligned, the intake air flows over the indentation 3, out the intake air bypass 25 in the cylinder head 20 (See FIG. 6) and to the next cylinder aligned for intake via port 113 and a connected manifold (not shown). In the exhaust phase, when opening port 2 of rotary distribution element 1 is aligned with exhaust port 22 of cylinder head 20 (See FIG. 7) and the valve 10 is open, exhaust gas leaves the cylinder via exhaust gas manifold 102 in the direction of the arrows.

Figure 17:
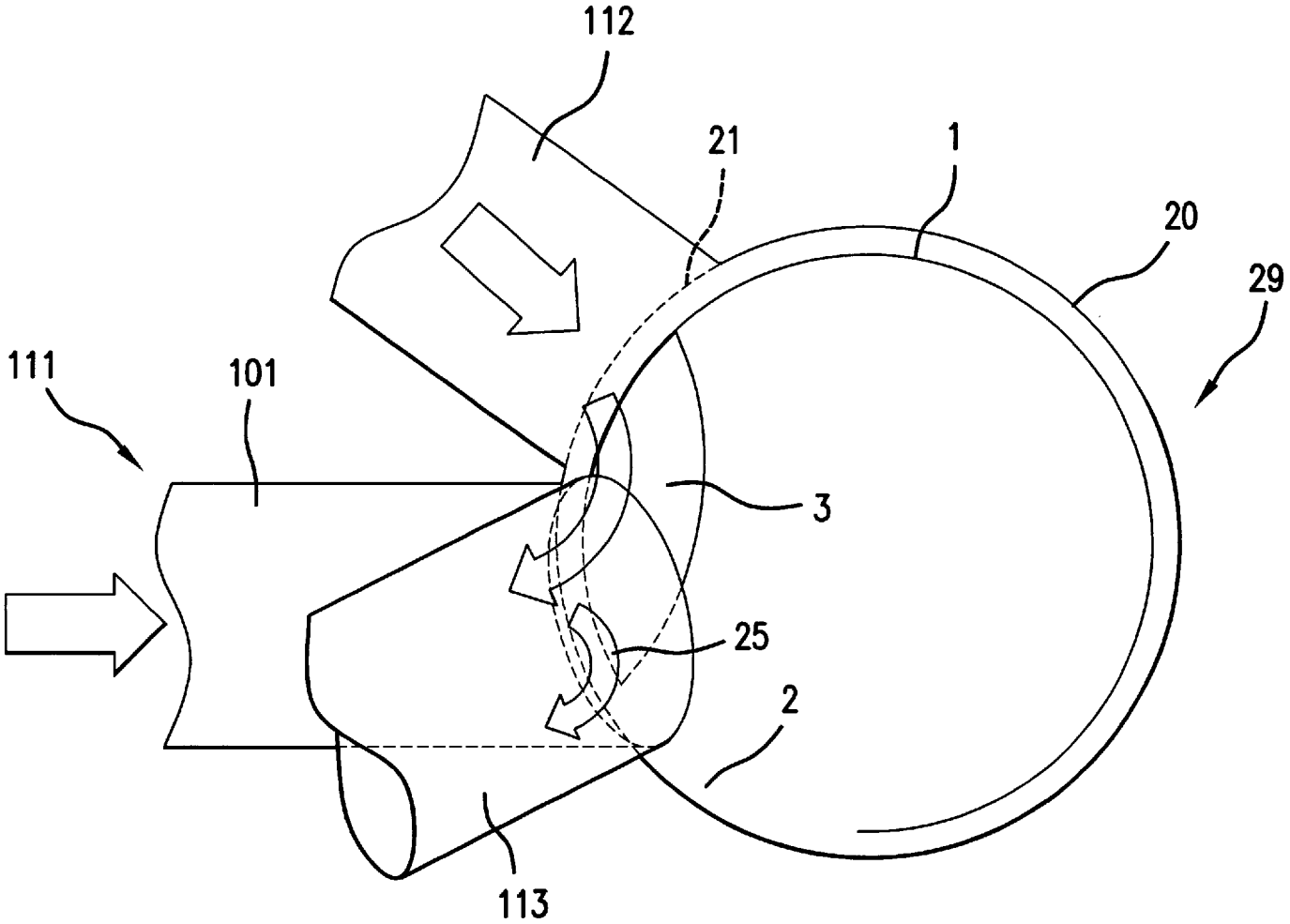
FIG. 17 shows a detail view of intake air flow at the latter end of the intake phase according to the present invention.

FIG. 17 is a detail view of the flow of intake air at the intake of cylinder head assembly 29 at the end of the intake phase. As the end of the intake phase nears, only a small portion of opening port 2 remains aligned with intake port 21 of cylinder head 20; the majority of intake port 21 is aligned with indentation 3. At this point the air flow from port 111 and the recirculated air flow from port 112 flow over indentation 3 out the intake air bypass 25 and up into port 113. Through a manifold this air flow proceeds to the next cylinder.

Figure 18:
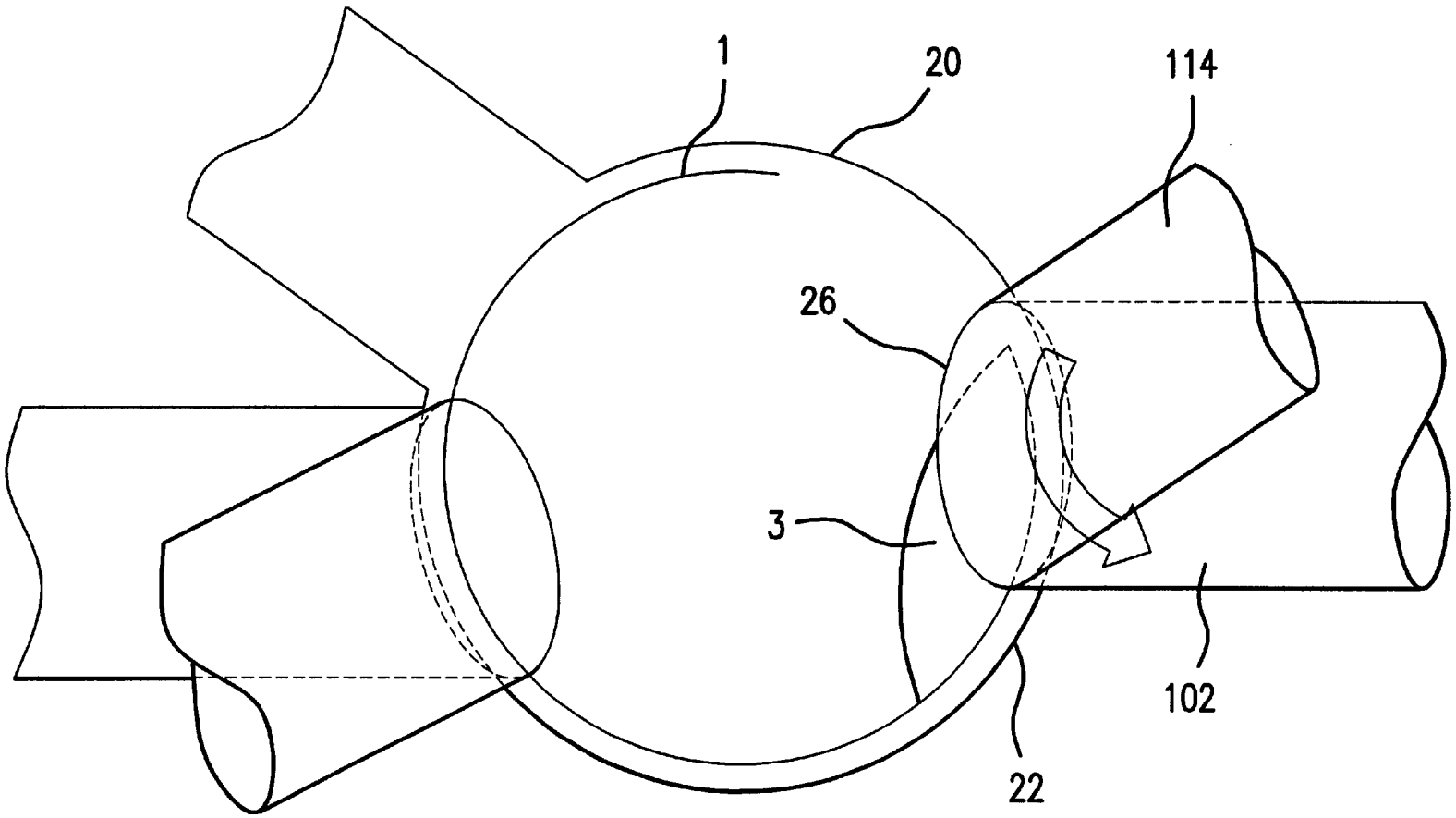
FIG. 18 shows a detail view of fresh air supply flow at the latter end of the exhaust phase according to the present invention.

FIG. 18 is a detail view of the flow of fresh air during exhaust scavenging at the exhaust of cylinder head assembly 29 at the end of the exhaust phase. As the end of the exhaust phase nears, only a small portion of opening port 2 aligns with exhaust port 22 of the cylinder head 20; the majority of exhaust port 22 is aligned with indentation 3. At this point a supply of fresh air flowing from port 114 through fresh air supply port 26 is combined with the exhaust gas flow in the exhaust gas manifold 102 to accomplish exhaust scavenging.

Figure 19:
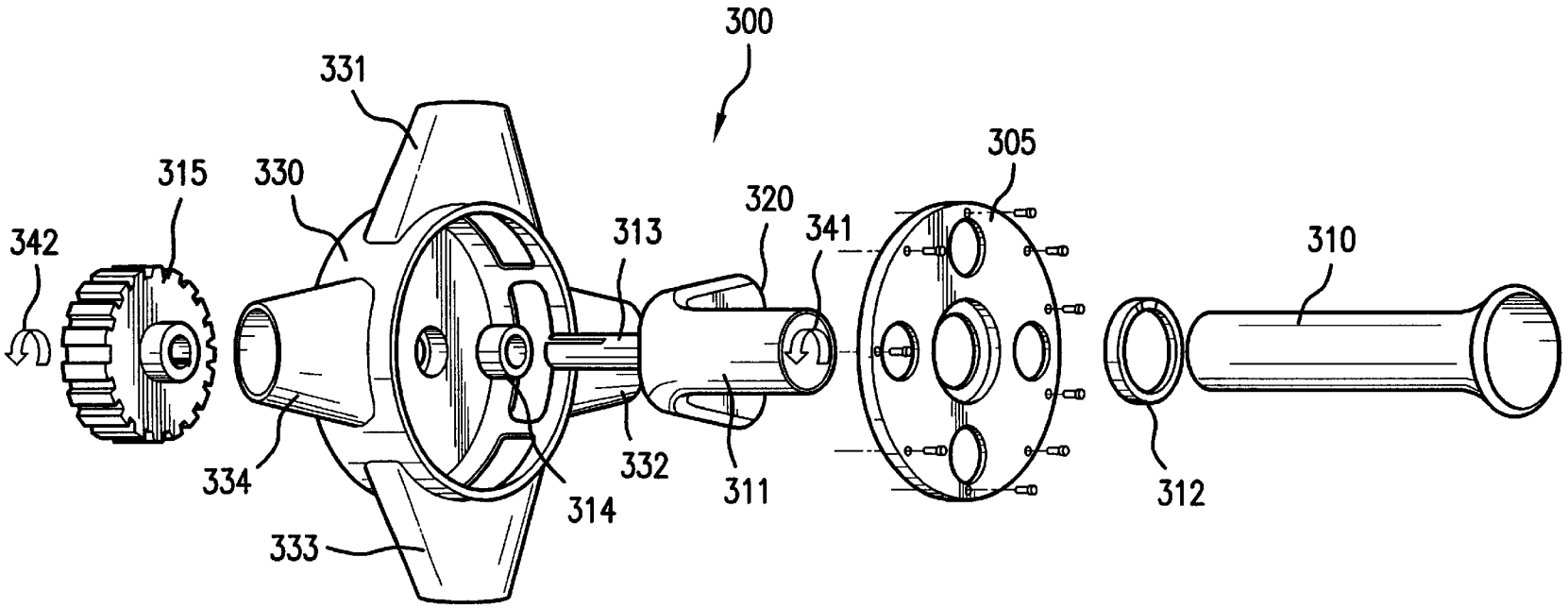
FIG. 19 shows an exemplary external flow director according to the present invention.

FIG. 19 shows an external flow director 300 to deliver intake air to each of the cylinders. As shown in FIG. 16, intake air manifold 101 can combine air taken through port 111 with recirculated air delivered via port 112. External flow director 300, shown in FIG. 19, can be used to direct air to port 111 of multiple cylinders. FIG. 19 shows the external flow director 300 having an intake air tube 310 that is connected to a delivery tube 311 by a seal 312. Delivery tube 311 is rotatably mounted in delivery housing 330 and held in place by delivery housing top plate 305 which can be mounted on the delivery housing 300 by, for example, a series of screws or rivets. Seal 312 allows a connection between delivery tube 311 which rotates and intake air tube 310 which can either rotate or remain fixed. Delivery tube 311 has a rod-shaped projection 313 that when the delivery tube 311 is mounted in the delivery housing 330, projects out an opening in the delivery housing 330. A bearing 314 is mounted around the rod-shaped projection 313 to allow the delivery tube 311 to rotate. Rod-shaped projection 313 is connected to drive gear 315 which may be connected to a gear assembly (not shown) to allow rotation of the delivery tube 311.

As delivery tube 311 rotates in delivery housing 330, output port 320 of delivery tube 311 aligns with a series of ports 331–334 of the delivery housing. When the output port 320 is aligned with any one of the ports 331–334, intake air flows into intake air tube 310 to delivery tube 311 and out of the output port 320 to the particular port 331–334 with which the output port 320 is aligned. The intake air can then be directed from the ports 331–334 to port 111, as shown in FIG. 16, of an intake cylinder. For example, a manifold system can direct intake air from port 331 to the first cylinder of a four-cylinder engine, intake air from port 332 can be directed to the second cylinder, intake air from port 333 can be directed to the third cylinder, and intake air from port 334 can be directed to the fourth cylinder. The external flow director 300 shown in FIG. 19 has four ports 331–334, but those skilled in the art will understand that the delivery housing 330 can have any number of ports and that a single port may be used to supply air to more than one cylinder by using, for example, manifold system. Those skilled in the art will understand that the speed of rotation of the delivery tube 311 is determined based on the timing of the cylinders, such that the intake air is directed to each cylinder, at the same time that the recirculated air is arriving at that cylinder. It should also be understood that the rotation of the delivery tube 311 and drive gear 315 as shown by arrows 341 and 342, respectively, is only exemplary and that the rotation can be in either direction.

Figure 20:
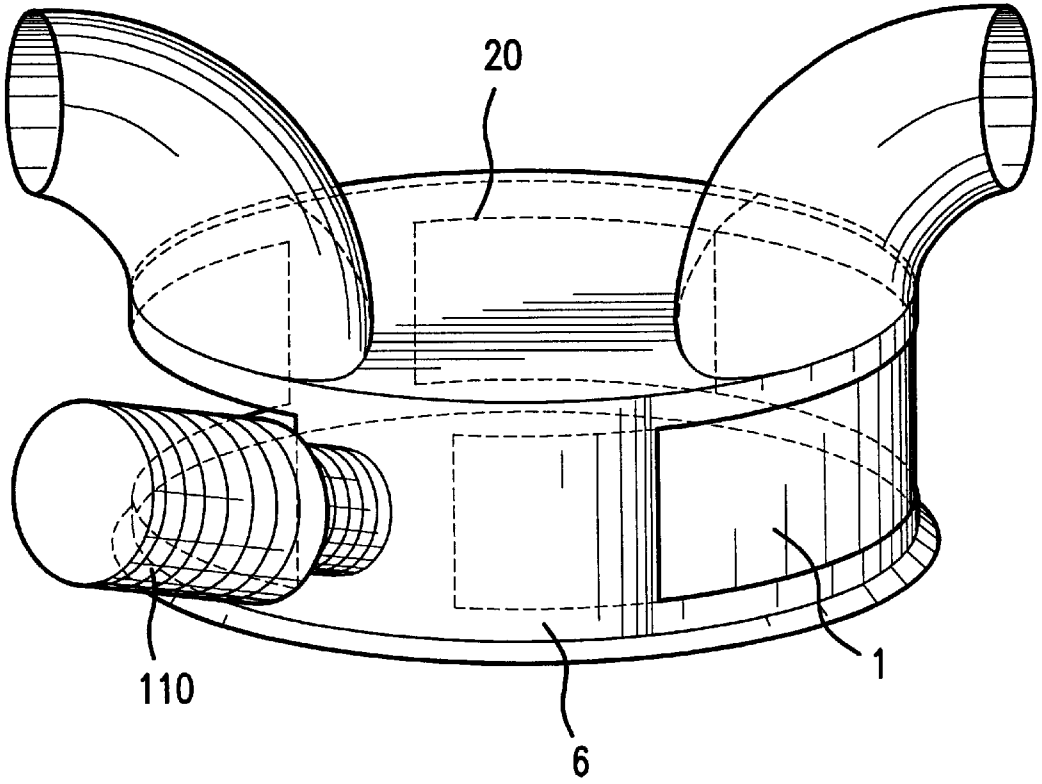
FIG. 20 shows an exemplary cylinder head assembly with a semi-direct fuel injection according to the present invention.

As described above, the present invention is not limited to any specific type of fuel injection method. FIG. 20 illustrates an apparatus to accomplish a semi-direct fuel injection according to the present invention. Fuel injector 110 is inserted into cylinder head 20 such that fuel can be injected into hollow inside cavity 6 to mix with the intake air before or while poppet valve 10 (not shown) is open to allow the air-fuel mixture in hollow inside cavity 6 to flow into the main combustion chamber (not shown). In a direct injection engine, a fuel injector would be oriented such that fuel could be injected directly into the main combustion chamber, while in an indirect injection engine, the fuel injector would be positioned to inject fuel into the intake air manifold prior to the flow of the air/fuel mixture into the hollow inside cavity 6.

Figure 21:
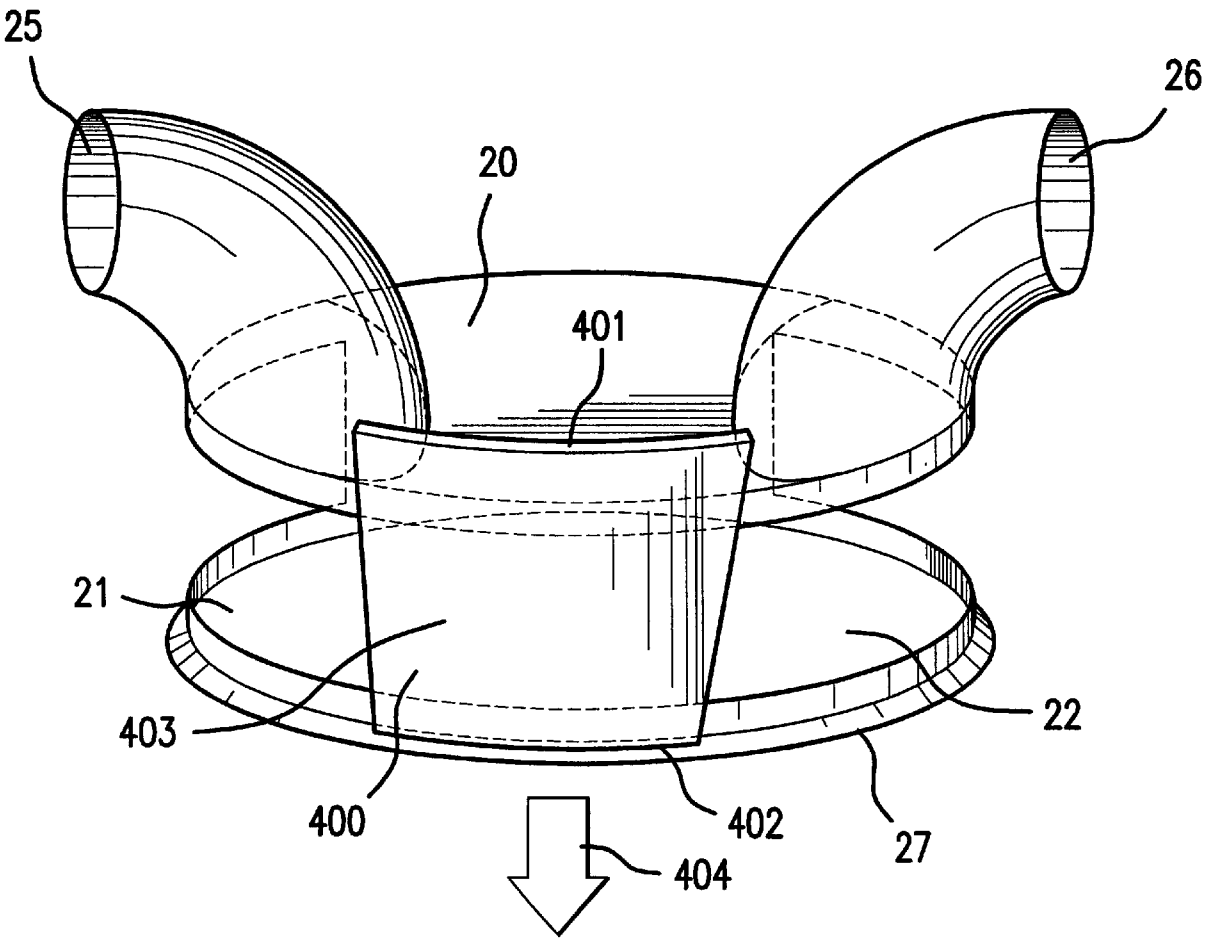
FIG. 21 shows an exemplary cylinder head with an exemplary variable port timing flap down according to the present invention.

FIG. 21 shows an alternative exemplary embodiment of engine cylinder head 20 according to the present invention. As described above with respect to FIG. 3, engine cylinder head 20 has an intake port 21, an exhaust port 22, a valve seat 27, an intake air bypass 25 and an exhaust fresh air supply port 26. In addition, cylinder head 20 shown in FIG. 21 also has a flap 400 that is mounted inside cylinder head 20. In this exemplary embodiment, flap 400 operates as a side wall of cylinder head 20 separating intake port 21 from exhaust port 22, such that if flap 400 were removed from cylinder head 20, intake port 21 and exhaust port 22 would form one continuous port. Flap 400 has a trapezoidal shape with a larger parallel side 401 and a smaller parallel side 402. The face 403 of flap 400 is generally curved having substantially the same curvature as cylinder head 20 so that it can operate as a side wall of cylinder head 20. Flap 400 is movably mounted inside cylinder head 20, such that it can move up and down, and left and right. It should be noted that flap 400, as shown in FIG. 21, has an exaggerated size for the purposes of illustration, appearing larger than the inside of cylinder head 20. The actual size of flap 400 is such that it can be movably mounted inside cylinder head 20 as described above.

The purpose of flap 400 is to provide variable port timing for an engine implementing the present invention. In FIG. 21, flap 400 is moved to the down position as indicated by arrow 404. In this down position, the larger parallel side 401 of flap 400 covers a larger portion of the intake port 21 and the exhaust port 22 of cylinder head 20. The smaller intake port 21 and exhaust port 22 operate to choke the cylinder based on the lower air flow through smaller ports. Those skilled in the art will understand that the movement of flap 400 can be controlled by any conventional mechanical or electromechanical means, for example, a gear mechanism or a solenoid valve.

Figure 22:
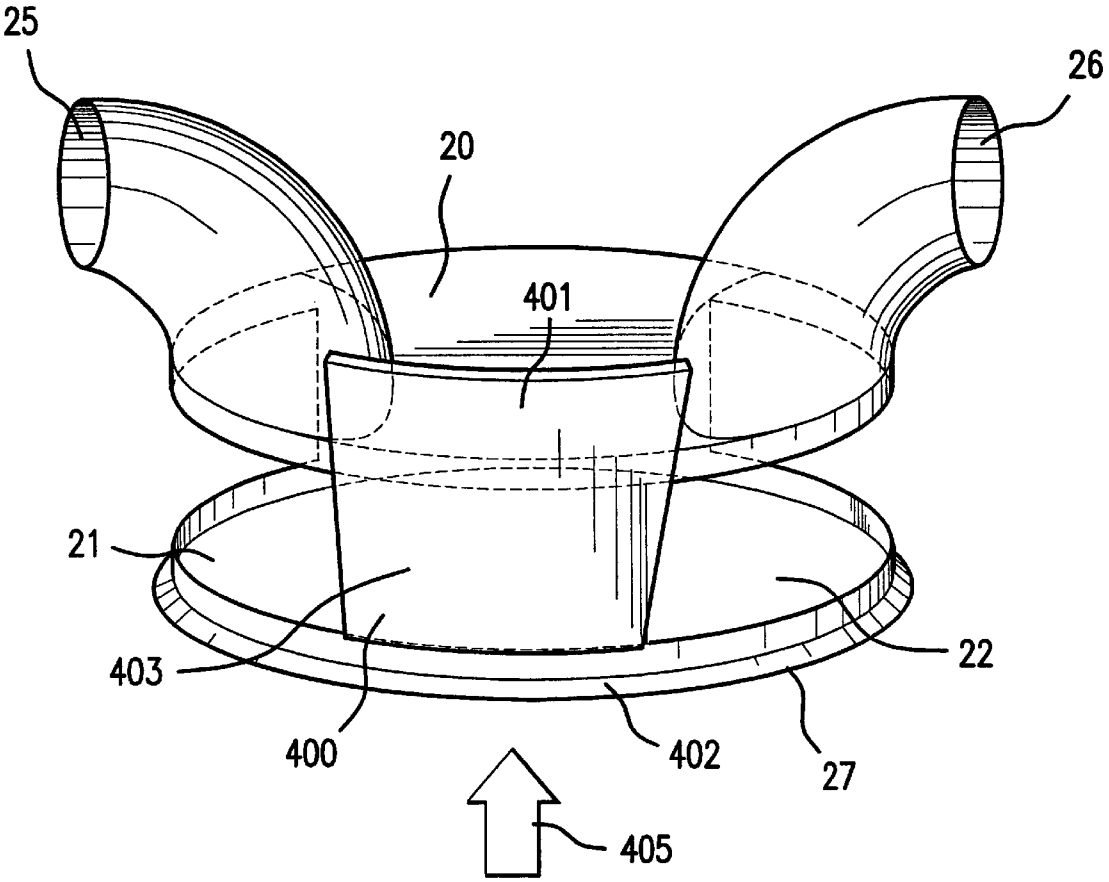
FIG. 22 shows an exemplary cylinder head with an exemplary variable port timing flap up according to the present invention.
Figure 23:
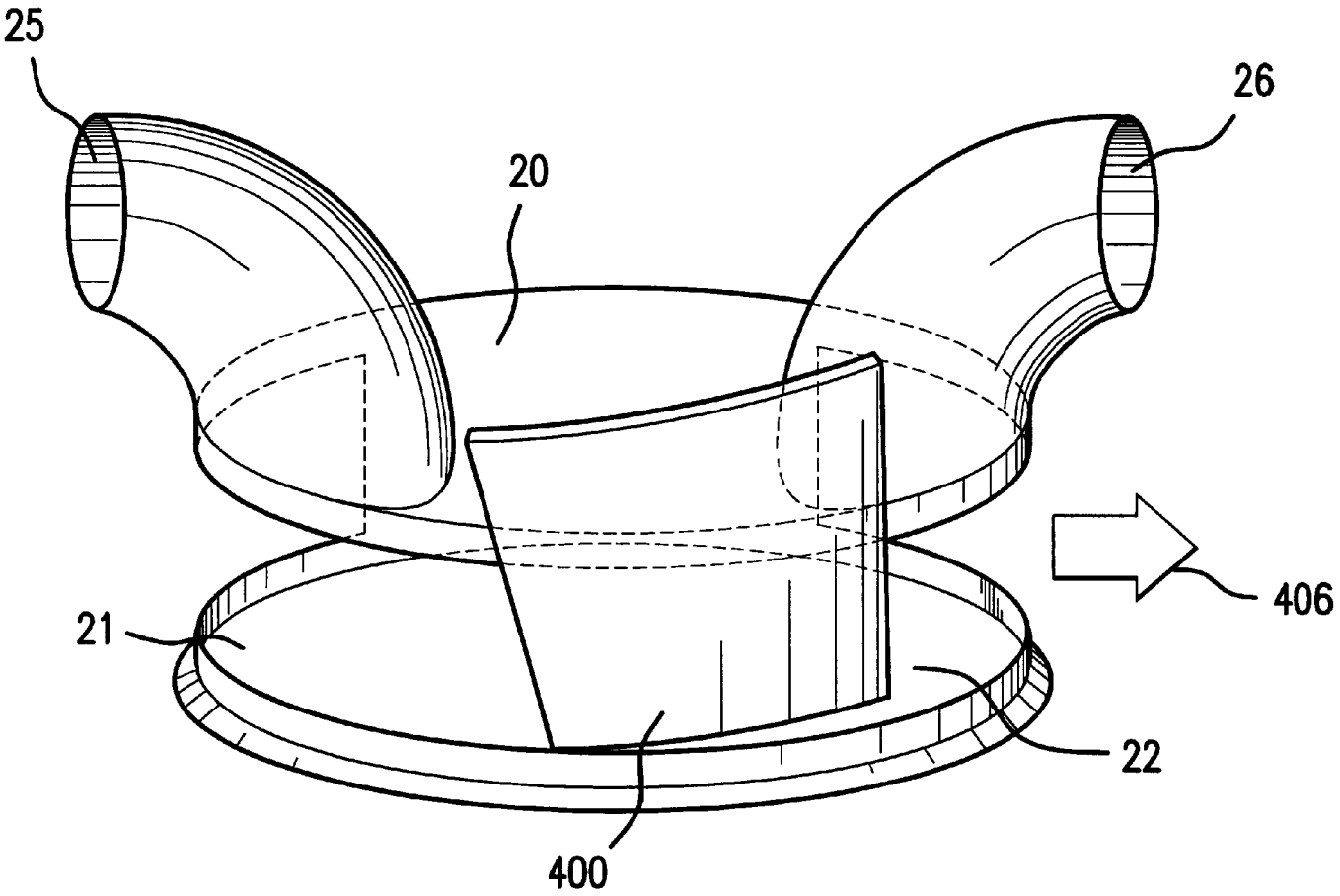
FIG. 23 shows an exemplary cylinder head with an exemplary variable port timing flap movable to the intake or exhaust side according to the present invention.

FIG. 22 shows the same cylinder head 20 with flap 400 moved to the up position as indicated by arrow 405. In this up position, the smaller parallel side 402 of flap 400 covers a smaller portion of the intake port 21 and the exhaust port 22 of cylinder head 20 causing maximum port openings for cylinder head 20. FIG. 23 shows the same cylinder head 20 with flap 400 moved to the right position as indicated by arrow 406. In this position, the intake port 21 is enlarged while the exhaust port 22 is smaller. Similarly, the flap may be moved to the left position (not shown) enlarging the exhaust port 22 and making the intake port 21 smaller. It should be understood that movement in any of the four described directions can be incremental based on the desired timing of the cylinder. For example, in FIG. 23, flap 400 may be able to move more or less in the right direction. The movements can also be combined, for example, in FIG. 23, flap 400 is shown as moved both in the right direction and the up direction. Those skilled in the art will understand that by controlling the size of the intake port 21 and the exhaust port 22 of cylinder head 20 an engine implementing the present invention can have variable port timing.

Figure 24:
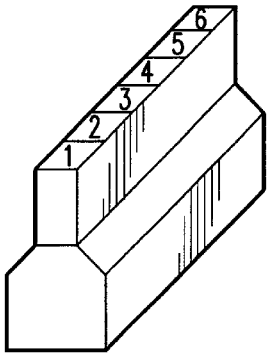
FIG. 24 shows typical engine designs and exemplary firing orders.
Figure 24:
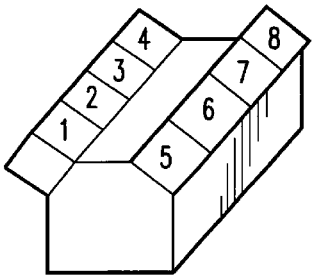
Figure 24:
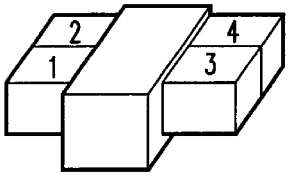

FIG. 24 shows three typical engine types, the typical number of cylinders, and the normal firing order for these cylinders. For example the first engine is an in-line engine having 4,5, 6 or 8 cylinders with the illustrated exemplary firing orders. The second engine is a V-type engine having 4,6 or 8 cylinders with the illustrated exemplary firing orders. Finally, the third engine is a horizontally opposed engine having 4 cylinders with the illustrated exemplary firing order. The cylinder head assembly of the present invention can be adapted for use on any of these engines, or any other engine type, and the manifold system can be adapted to allow intake air flow to be directed to the cylinders in the proper firing order. Additionally, the present invention can be applied to any type of engine (e.g. land, marine, aviation) and is not limited by the type of fuel (e.g. gasoline, diesel, JP fuel, natural gas).

Alternative Embodiment

Figure 25:
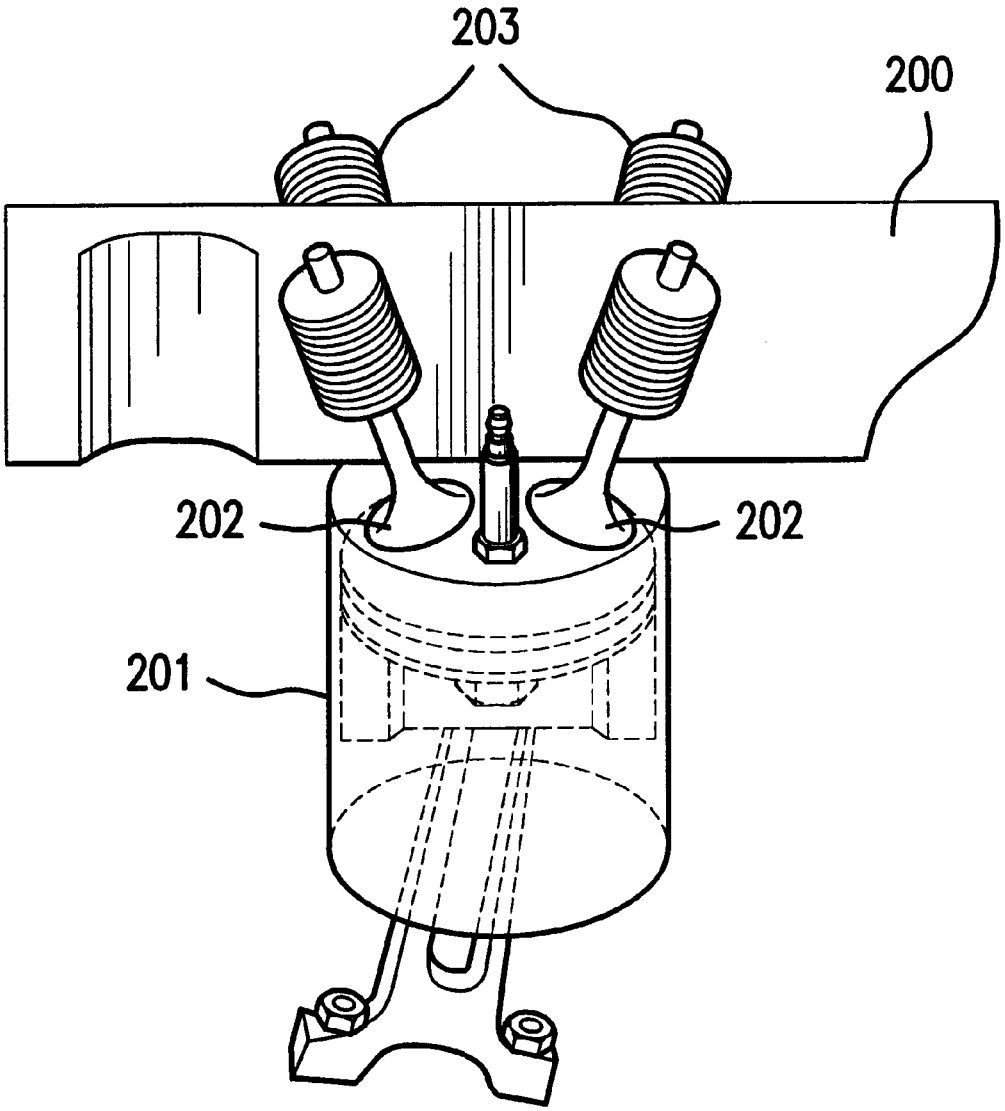
FIG. 25 shows a rotary distribution tube mounted on an engine cylinder according to the present invention.

FIG. 25 shows an alternative embodiment of the present invention, using a rotary distribution tube 200 on a single engine cylinder 201. The engine cylinder 201 includes two intake valves 202, and two exhaust valves 203 (both of which are partially obscured by the rotary distribution tube 200). The rotary distribution tube 200 is installed on the top of the cylinder 201 between the intake valves 202 and exhaust valves 203 such that the openings of the valves are at least partially covered by the rotary distribution tube 200.

Figure 26:
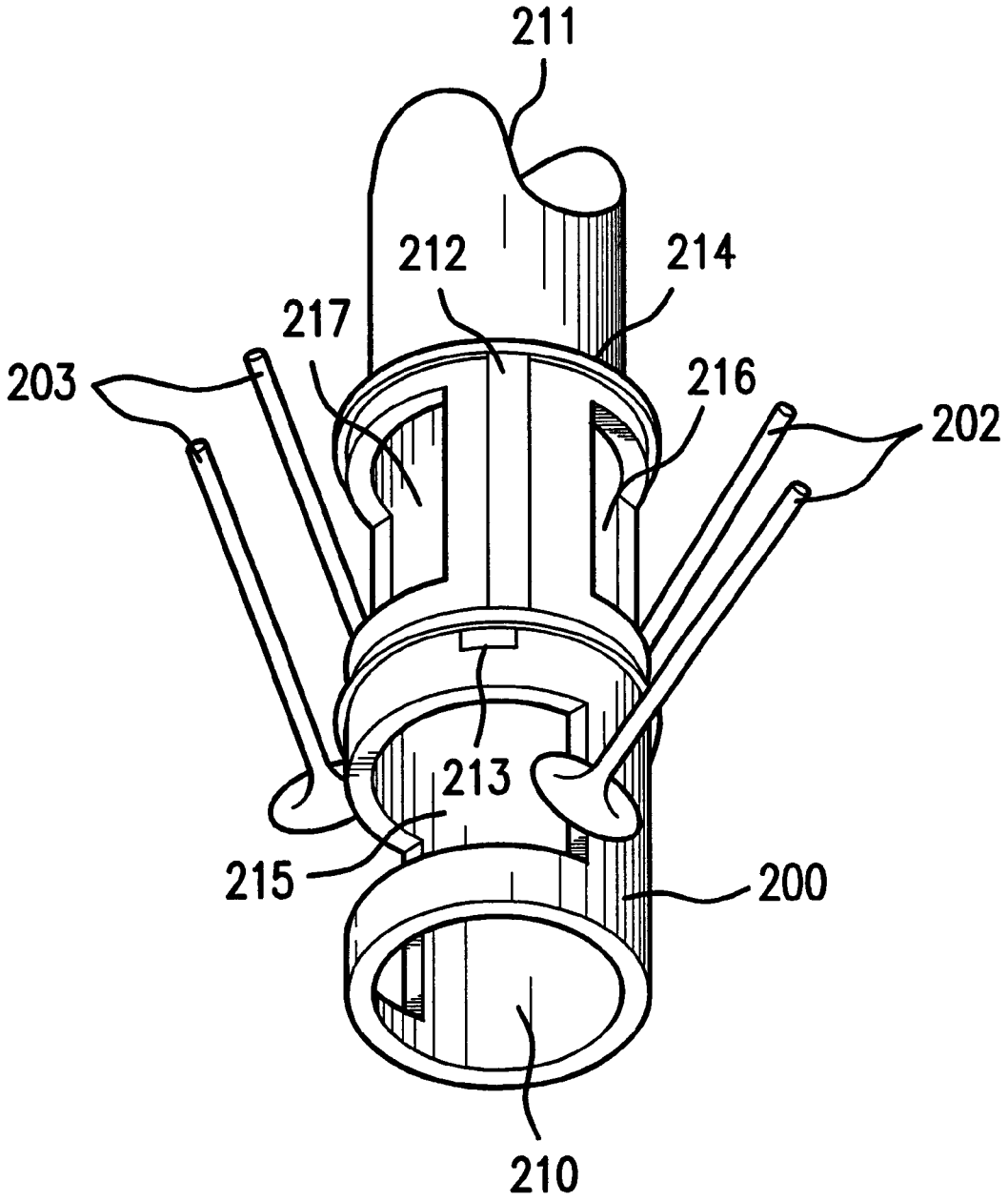
FIG. 26 shows a rotary distribution tube according to the present invention.
Figure 27:
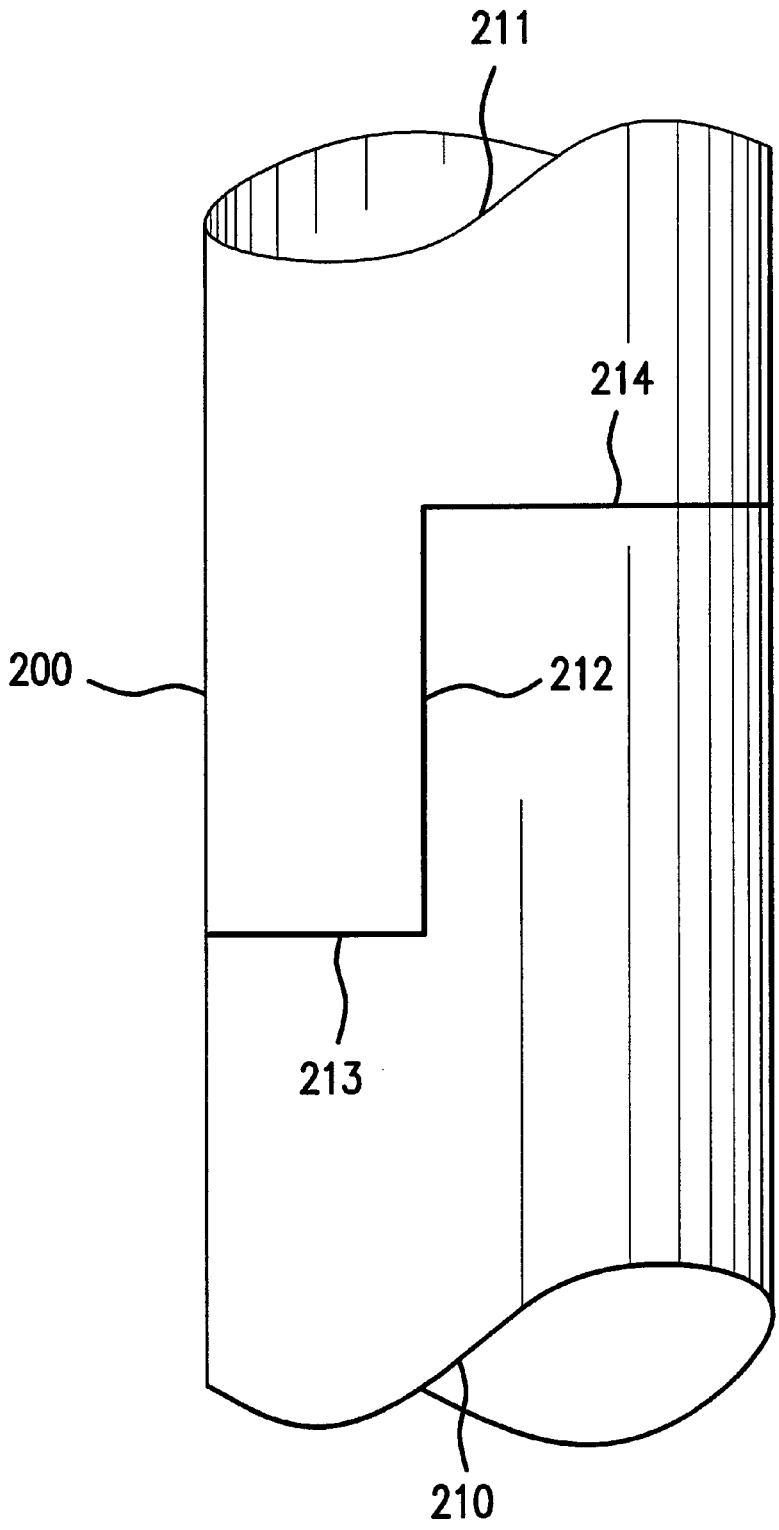
FIG. 27 shows a longitudinal cross-section of the rotary distribution tube according to the present invention.

FIG. 26 shows the rotary distribution tube 200, according to the present invention. The rotary distribution tube 200 has an intake side 210 and an opposing exhaust side 211. The center of rotary distribution tube 200 is hollow, except for a wall 212 and two semicircular plates 213, 214, that separate the intake side 210 from the exhaust side 211. FIG. 27 shows a longitudinal cross-section of the of the rotary distribution tube 200. From this view it can be seen that wall 212 and semicircular plates 213, 214 completely segregate the intake side 210 from the exhaust side 211. Referring back to FIG. 26, intake side 210 has a continuous air flow port 215 and an intake delivery port 216. Exhaust side 211 has an exhaust delivery port 217. The rotary distribution tube 200 is shown as arranged between the intake valves 202 and exhaust valves 203. Those skilled in the art will understand that the rotary distribution tube 200 can be formed as one integral piece or as a series of pieces which are connected and contain a series of seals to assure separation between the intake side 210 and exhaust side 211.

Figure 28:
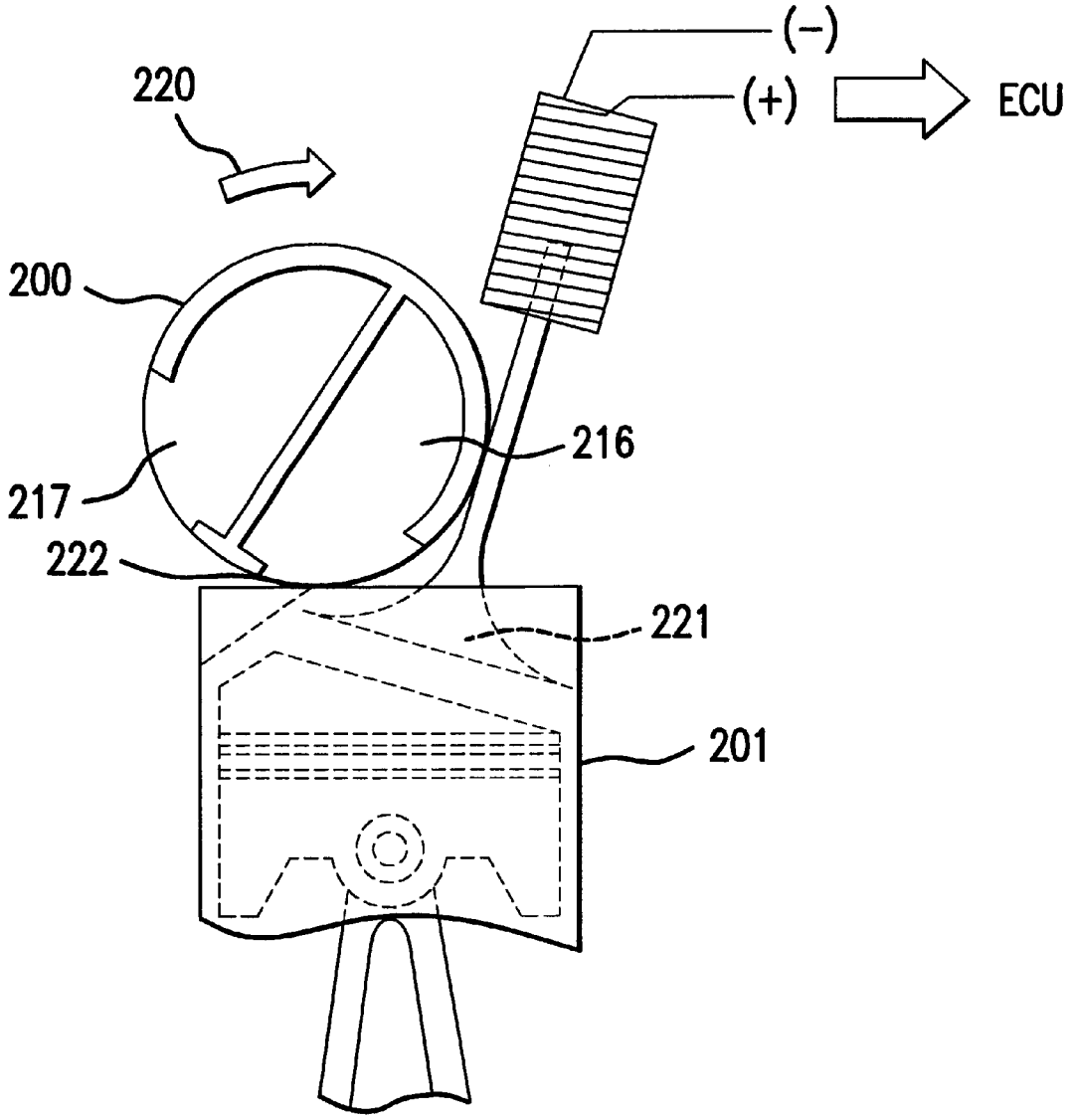
FIG. 28 shows a side view of the rotary distribution tube mounted on an engine cylinder according to the present invention.

Operation of the rotary distribution tube 200 will be explained with reference to FIG. 28. Engine cylinder 201 is shown with a single valve 221 having a valve opening 222. The valve 221 can be, for example, a solenoid controlled valve. Rotary distribution tube 200 is arranged such that as it rotates in the direction of arrow 220, each of the intake delivery port 216 and the exhaust delivery port 217 are aligned with the valve opening 222 for a period of time during each rotation. While valve 221 is open and the intake delivery port 216 is aligned with the valve opening 222 during the intake phase of cylinder 201, intake air is drawn into the cylinder 201 through the intake side 210 and continuous air port 215 (shown in FIG. 26) of the rotary distribution tube 200. While valve 221 is open and the exhaust delivery port 217 is aligned with the valve opening 222 during the exhaust phase of cylinder 201, exhaust gas is expelled through the exhaust side 211 (shown in FIG. 26) of rotary distribution tube 200. Those skilled in the art will understand that the rotary distribution tube 200 can be used with multiple valves on a single cylinder as illustrated in FIG. 26. The only requirement is that the intake delivery port 216 must align with the openings of all valves used for intake and the exhaust delivery port 217 must align with the openings of all valves used for exhaust.

As explained above with reference to the rotary distribution element 1, an internal combustion engine with multiple cylinders having rotary distribution tubes 200 can be interconnected through the use of a manifold system to create a continuous flow of intake air through the engine to eliminate air stagnation at any one of the cylinders.

What is claimed is:

1. An intake system for an internal combustion engine having a plurality of cylinders that fire in a predetermined order, comprising:

a first intake passage extending between a first intake port of a first one of the plurality of cylinders and a second intake port of a second one of the plurality of cylinders, wherein the first cylinder fires first in the predetermined order and the second cylinder fires second in the predetermined order, wherein the first cylinder includes a first distribution element, wherein during an intake phase of the first cylinder, the first distribution element directs intake air into the first intake port, and wherein, at the conclusion of the intake phase of the first cylinder, the first distribution element directs air to the second intake port via the first intake passage so that the air arrives at the second intake port during an intake phase of the second cylinder; and a final intake passage extending from an intake port of a final one of the plurality of cylinders to the first intake port, wherein the final cylinder fires last in the predetermined firing order, wherein the final cylinder includes a final distribution element and wherein, at the conclusion of an intake phase of the final cylinder, the final distribution element directs air to the first intake port via the final intake passage so that the air arrives at the first intake port during an intake phase of the first cylinder.

2. An internal combustion engine having a plurality of cylinders, comprising:

a first movably mounted distribution element from a plurality of moveable mounted distribution elements, wherein, the first distribution element, in a first configuration, fluidly couples an intake port of a first one of the plurality of cylinders with a combustion chamber of the first cylinder, wherein, the first distribution element, in a second configuration, fluidly couples the combustion chamber of the first cylinder with an exhaust port of the first cylinder, wherein, the first distribution element, in a third configuration, diverts intake air flow from the intake port of the first cylinder to an intake port of a second one of the plurality of cylinders, wherein, at the conclusion of the intake phase of the first cylinder, the first distribution element is moved into the third configuration, wherein, the second cylinder fires immediately subsequent to the first cylinder in a firing order of the engine, wherein, each of the subsequent distribution elements from the plurality of moveably mounted distribution elements are associated with a corresponding one of the plurality of cylinders which fire after the first cylinder in the firing order, wherein, in a first configuration, each of the subsequent distribution elements fluidly couples an intake port of the corresponding cylinder with a combustion chamber of the corresponding cylinder and wherein, in a second configuration, each subsequent distribution element fluidly couples the combustion chamber of the corresponding cylinder with an exhaust port of the corresponding cylinder, wherein, in a third configuration each of the subsequent distribution elements diverts intake air flow from the intake port of the corresponding cylinder to an immediately subsequent cylinder which, in the firing order, fires immediately subsequent to the corresponding cylinder, wherein, the subsequent distribution element corresponding to the final cylinder is moved into the third configuration at the conclusion of the intake phase of the final cylinder and diverts intake air flow from the intake port of the final cylinder to the intake port of the first cylinder through the final passage;

a first passage extending from the intake port of the first cylinder to the intake port of the second cylinder; and a final passage extending from an intake port of a last firing cylinder in the firing order to the intake port of the first cylinder.

3. The internal combustion engine according to claim 2, further comprising a second source of intake air for each of the cylinders, wherein the intake air from the second source is combined with the diverted intake air prior to entering each cylinder.

4. The internal combustion engine according to claim 3, wherein the second source of intake air is an external flow director supplying intake air to each of the cylinders.

5. The internal combustion engine according to claim 2, wherein the first distribution element is rotatably mounted within a cylinder head and rotates between the first, second and third configurations.

6. The internal combustion engine according to claim 5, wherein the first distribution element has an opening port that, in the first configuration, aligns with an intake port of the cylinder head.

7. The internal combustion engine according to claim 5, wherein the first distribution element has an opening port that, in the second configuration, aligns with an exhaust port of the cylinder head.

8. The internal combustion engine according to claim 2, wherein at least one of the first and subsequent distribution elements includes an indentation which, in the third configuration, diverts intake air flow to the cylinder firing immediately subsequent to the cylinder corresponding to the at least one of the first and subsequent distribution elements.

9. The internal combustion engine according to claim 6, further including a first valve, wherein the first distribution element has a hollow inside cavity, wherein the first valve separates the hollow inside cavity from the combustion chamber of the first cylinder, and wherein the first valve is open when the first distribution element is in the first configuration.

10. An engine cylinder having a combustion chamber, an intake passage and an exhaust passage for use in an internal combustion engine, comprising:

a cylinder head having an intake port and an exhaust port;

a rotary distribution element having an opening port which rotates with respect to the cylinder head so that, in a first orientation, the distribution element is aligned with the intake port and, in a second orientation, the distribution element is aligned with the exhaust port; and a valve which, when closed, substantially seals the combustion chamber and which, when open, fluidly communicates the opening port with the combustion chamber so that, when the distribution element is in the first orientation and the valve is open, the combustion chamber is in fluid communication with the intake port and, when the distribution element is in the second orientation and the valve is open, the combustion chamber is in fluid communication with the exhaust port, wherein an indentation is formed in an outer surface of the distribution element and wherein intake air is redirected through an intake air bypass port of the engine cylinder head when the indentation is aligned with the intake port of the engine cylinder head.

11. The engine cylinder according to claim 10, wherein the intake port is in fluid communication with the combustion chamber during an intake phase of the cylinder.

12. The engine cylinder according to claim 11, wherein the valve remains open during the entire intake phase of the cylinder.

13. The engine cylinder according to claim 10, wherein the exhaust passage is in fluid communication with the combustion chamber during an exhaust phase of the cylinder.

14. The engine cylinder according to claim 13, wherein the valve remains open during the entire exhaust phase of the cylinder.

15. The engine cylinder according to claim 10, wherein the rotary distribution element is rotatably disposed in the cylinder head.

16. The engine cylinder according to claim 10, wherein the indentation is aligned with the intake port at the conclusion of an intake phase of the cylinder.

17. The engine cylinder according to claim 10, wherein an indentation is formed in an outer surface of the distribution element and wherein fresh air is directed through a fresh air supply port in the engine cylinder head and out through the exhaust port when the indentation is aligned with the exhaust port of the engine cylinder.

18. The engine cylinder according to claim 17, wherein the indentation is aligned with the exhaust port at the conclusion of an exhaust phase of the cylinder.

19. The engine cylinder according to claim 10, further comprising a solenoid for controlling the valve.

20. An engine cylinder having a combustion chamber, an intake passage and an exhaust passage for use in an internal combustion engine, comprising:

a cylinder head having an intake port and an exhaust port;

a movable flap mounted inside the cylinder head, wherein movement of the flap affects a size of the intake port and the exhaust port;

a rotary distribution element having an opening port which rotates with respect to the cylinder head so that, in a first orientation, the distribution element is aligned with the intake port and, in a second orientation, the distribution element is aligned with the exhaust port; and a valve which, when closed, substantially seals the combustion chamber and which, when open, fluidly communicates the opening port with the combustion chamber so that, when the distribution element is in the first orientation and the valve is open, the combustion chamber is in fluid communication with the intake port and, when the distribution element is in the second orientation and the valve is open, the combustion chamber is in fluid communication with the exhaust port.

21. The engine cylinder of claim 20, wherein a first position of the flap enlarges the intake port and the exhaust port, a second position of the flap reduces the intake port and the exhaust port, and a third position enlarges one of the intake port and exhaust port and reduces the other one of the intake port and exhaust port.

22. An internal combustion engine comprising:

a plurality of cylinders, each cylinder forming a combustion chamber therewithin and having an intake and an exhaust port associated therewith;

a plurality of valves, wherein each valve is associated with a corresponding one of the plurality of cylinders so that, when a respective one of the valves is closed, the combustion chamber of a corresponding one of the cylinders is substantially sealed;

a plurality of distribution elements, each distribution element being movably mounted adjacent to a corresponding one of the valves, wherein the distribution element is a tube that rotates about a longitudinal axis thereof, wherein the tube has an intake lumen and an exhaust lumen extending therethrough, with the intake and exhaust lumens being sealed from one another, wherein, when the intake lumen of a respective one of the distribution elements is aligned with the corresponding intake port and the corresponding valve is open, the corresponding combustion chamber is fluidly coupled with the corresponding intake port and wherein, when the exhaust lumen of the respective one of the distribution elements is aligned with the corresponding exhaust port, the corresponding combustion chamber is fluidly coupled with the corresponding exhaust port.

23. An internal combustion engine comprising:

a plurality of cylinders, each cylinder forming a combustion chamber therewithin and having an intake and an exhaust port associated therewith, a plurality of valves, wherein each valve is associated with a corresponding one of the plurality of cylinders so that, when a respective one of the valves is closed, the combustion chamber of a corresponding one of the cylinders is substantially sealed;

a plurality of distribution elements, each distribution element being movably mounted adjacent to a corresponding one of the valves, wherein each distribution element has at least one opening extending therethrough, wherein, when the at least one opening of a respective one of the distribution elements is aligned with the corresponding intake port and the corresponding valve is open, the corresponding combustion chamber is fluidly coupled with the corresponding intake port, wherein, when the at least one opening of the respective one of the distribution elements is aligned with the corresponding exhaust port, the corresponding combustion chamber is fluidly coupled with the corresponding exhaust port, wherein the plurality of cylinders fire in a predetermined firing order, and further include, a first passage extending from the intake port of the first one of the cylinders to an intake port of a second one of the cylinders wherein, at the completion of an intake phase of the first cylinder, intake air is diverted through the first passage to the intake port of the second cylinder, wherein the first cylinder fires first in the predetermined firing order and the second cylinder fires immediately subsequent to the first cylinder in the predetermined firing order; and a final passage extending from the intake port of a last one of the cylinders to the intake port of the first cylinder wherein, at the completion of an intake phase of the last cylinder, intake air is diverted through the final passage to the intake port of the first cylinder, wherein the final cylinder fires last in the predetermined firing order.

24. The internal combustion engine according to claim 23, wherein the distribution element is rotatably mounted within the cylinder head.

25. A method for operating the intake system of an internal combustion engine having a plurality of cylinders that fire in a predetermined firing order, comprising the steps of:

admitting, through a first individual intake passage, an intake air flow into a first one of the plurality of cylinders during an intake phase of the first cylinder, wherein the first cylinder fires first in the predetermined firing order;

when the intake phase of the first cylinder has ended, redirecting the intake air flow, through a second individual intake passage, to an intake port of a second one of the plurality of cylinders, wherein the second cylinder fires immediately subsequent to the first cylinder in the predetermined firing order; and at the conclusion of an intake phase of a final one of the plurality of cylinders, redirecting the intake flow, through a final individual intake passage, to the intake port of the first cylinder, wherein the final cylinder fires last in the predetermined firing order.

26. A method for operating the intake system of an internal combustion engine having a plurality of cylinders that fire in a predetermined firing order, comprising the steps of:

admitting, through a first intake passage, an intake air flow into a first one of the plurality of cylinders during an intake phase of the first cylinder, wherein the first cylinder fires first in the predetermined firing order; and when the intake phase of the first cylinder has ended, redirecting the intake air flow, through a second intake passage, to an intake port of a second one of the plurality of cylinders, wherein the second cylinder fires immediately subsequent to the first cylinder in the predetermined firing order wherein the intake air flow is redirected at the conclusion of an intake phase of a respective one of the cylinders by aligning a rotatably mounted distribution element in a predetermined position relative to the intake flow.

27. A method for operating an internal combustion engine having a plurality of cylinders, comprising the steps of:

moving a first distribution element mounted adjacent to a first one of the cylinders, into a first configuration to fluidly couple an intake port of the first cylinder with a first combustion chamber thereof;

moving the first distribution element into a second configuration to fluidly couple the first combustion chamber with an exhaust port of the first cylinder; and moving the first distribution element into a third configuration that positions an indentation on the first distribution element to divert an intake air flow from the intake port of the first cylinder to an intake port of a second one of the plurality of cylinders.

28. The method for operating the internal combustion engine according to claim 27, further comprising the steps of:

firing each of the plurality of cylinders in a predetermined order, wherein the first cylinder fires first in the predetermined order, the second cylinder fires immediately subsequent to the first cylinder in the predetermined order and a final one of the cylinders fires last in the predetermined order;

wherein when the first distribution element is moved into the third configuration, the intake air flow is diverted to the intake port of the second cylinder via a first passage extending from the intake port of the first cylinder to the intake port of the second cylinder; and moving a final distribution element associated with the final cylinder into a configuration corresponding to the third configuration of the first distribution element to redirect the flow of intake air to the intake port of the first cylinder via a final passage extending from an intake port of the final cylinder to the intake port of the first cylinder.

29. The method for controlling the internal combustion engine according to claim 27, wherein the step of moving the first distribution element includes rotating the first distribution element, and wherein a speed of rotation is based on a speed of rotation of a crankshaft of the internal combustion engine.

30. A method for operating an internal combustion engine having a plurality of cylinders, comprising the steps of:

moving a first distribution element mounted adjacent to a first one of the cylinders, into a first configuration to fluidly couple an intake port of the first cylinder with a first combustion chamber thereof; and moving the first distribution element into a second configuration to fluidly couple the first combustion chamber with an exhaust port of the first cylinder, wherein the first distribution element is in the first configuration during an intake phase of the first cylinder, and wherein the first distribution element is in the second configuration during an exhaust phase of the first cylinder.

31. The method for controlling the internal combustion engine according to claim 27, wherein the first distribution element is in the third configuration at the conclusion of an intake phase of the first cylinder.

32. An intake system for an internal combustion engine having a plurality of cylinders that fire in a predetermined order and wherein each of the plurality of cylinders includes a corresponding air intake port associated therewith, the intake system comprising:

a plurality of individual intake passages extending between the air intake ports of the cylinders, wherein a first individual intake passage of the plurality of individual intake passages extends from an intake port of a first firing one of the cylinders to an intake port of a second firing one of the cylinders and to each of the plurality of cylinders in the same order as the predetermined firing order, and wherein the last individual intake passage extends from an intake port of a last firing one of the cylinders to the air intake port of the first firing cylinder.

33. The intake system according to claim 32, further comprising a plurality of second intake passages, each of the second intake passages extending from an intake manifold to a corresponding one of the air intake ports of the cylinders.

34. An intake system for an internal combustion engine having a plurality of cylinders that fire in a predetermined order, comprising:

a first separate intake passage fluidly connecting a first intake port of a first one of the plurality of cylinders and a second intake port of a second one of the plurality of cylinders, wherein the first cylinder fires first in the predetermined order and the second cylinder fires second in the predetermined order, wherein air is blown through the first separate intake passage fluidly connecting the first intake port of the first one of the plurality cylinders and the second intake port of the second one of the plurality of cylinders; and a final separate intake passage fluidly connecting an intake port of a final one of the plurality of cylinders to the first intake port, wherein the final cylinder fires last in the predetermined firing order.

* * * * *